US005415989A

United States Patent [19]

Wolff et al.

[11] Patent Number: 5,415,989

[45] Date of Patent: May 16, 1995

[54] COLOR PHOTOGRAPHIC RECORDING MATERIAL CONTAINING A COLOR COUPLER OF THE PYRAZOLOAZOLE SERIES

[75] Inventors: Erich Wolff, Solingen; Dieter Lowski, Frechen, both of Germany

[73] Assignee: Agfa-Givaert AG, Leverkusen, Germany

[21] Appl. No.: 199,479

[22] Filed: Feb. 22, 1994

[30] Foreign Application Priority Data

Mar. 8, 1993 [DE] Germany ..... 43 07 194.5

[51] Int. Cl.[6] ..... G03C 7/392; G03C 7/38

[52] U.S. Cl. ..... 430/551; 430/553; 430/556; 430/557; 430/558; 430/505

[58] Field of Search ..... 430/551, 558, 505, 553, 430/556, 557

[56] References Cited

U.S. PATENT DOCUMENTS 4,584,264 4/1986 Ohki et al. ..... 430/551
5,153,109 10/1992 Abe et al. ..... 430/551

FOREIGN PATENT DOCUMENTS 0489333 6/1992 European Pat. Off. .
1056347 3/1986 Japan ..... 430/551

*Primary Examiner*—Lee C. Wright
*Attorney, Agent, or Firm*—Connolly & Hutz

[57] ABSTRACT

Magenta dye images with excellent stability to light are obtained with a color photographic recording material which contains, associated with a light-sensitive silver halide emulsion layer, at least one magenta coupler corresponding to formula I and at least one compound corresponding to formula II.

I

In formula I,

R denotes H or a substituent;

X denotes H or a group which can be split off under the conditions of chromogenic development;

Z denotes the group required for completing a condensed ring containing nitrogen;

II.

In formula II, $R^1$, $R^2$ (identical or different) denote H, alkyl, aryl or a heterocyclic group; $R^1$ and/or $R^2$ may also combine with one of the groups $R^4$ to form a 5- to 7-membered heterocyclic ring containing at least one oxygen atom, $R^3$ denotes alkyl, alkenyl, aryl or a heterocyclic group;

$R^4$ denotes a substituent, e.g. halogen, CN, $NO_2$ or an organic radical such as, for example, alkyl, aryl, alkoxy, aryloxy, alkylthio, arylthio, amino, acylamino, sulphonamido, carbamoyl, alkoxycarbonyl, sulphamoyl or alkyl or arylsulphonyl; one group denoted by $R^4$ may combine with another group $R^4$ or with $R^1$ or $R^2$ to form a 5- to 7-membered ring, e.g. a condensed benzene ring, or together with $R^1$ or $R^2$ it may form an oxygen-containing ring;

n stands for 0 or an integer from 1 to 3.

17 Claims, 1 Drawing Sheet

Figure 1:
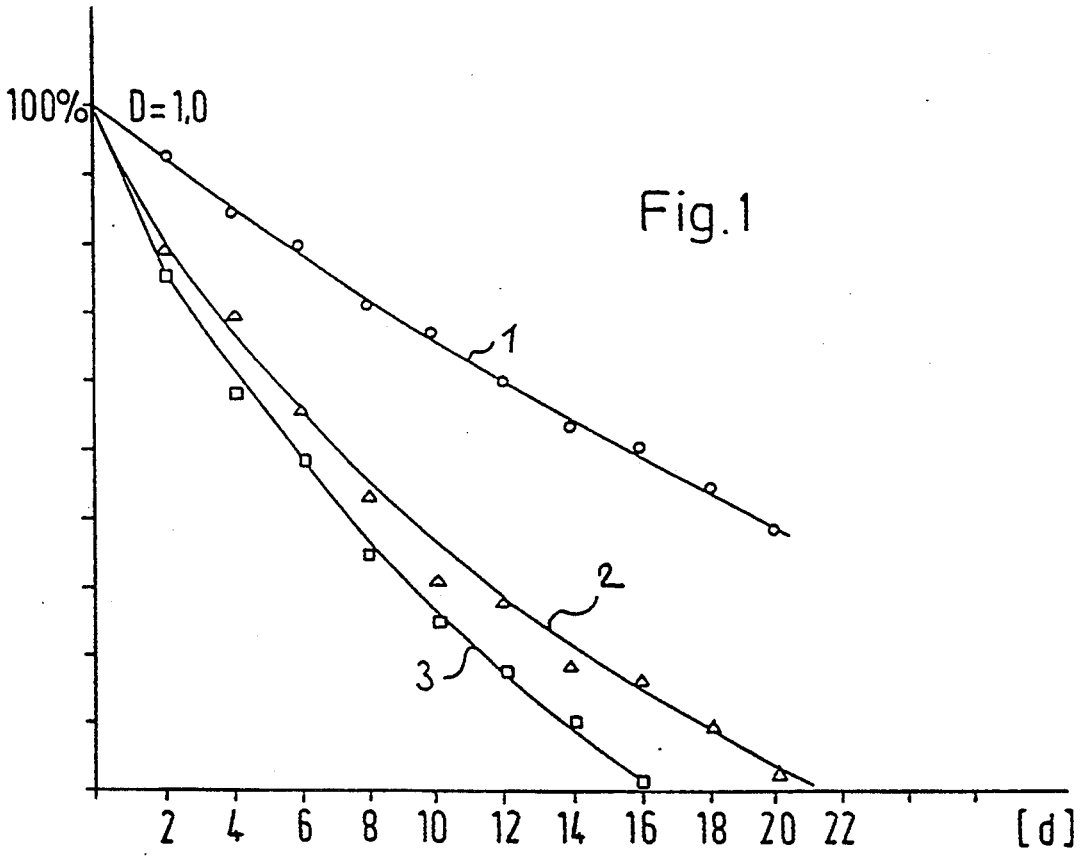

COLOR PHOTOGRAPHIC RECORDING MATERIAL CONTAINING A COLOR COUPLER OF THE PYRAZOLOAZOLE SERIES

This application relates to a light-sensitive colour photographic recording material in which the azomethine dyes formed in the green sensitive layer have improved stability to light.

3-Anilinopyrazolones have for many years been used as couplers for colour negative paper but these compounds have considerable side absorption in the region of 430 nm, causing marked impairment of the colour reproduction (see U.S. Pat. No. 2,343,703 and GB 1 059 994).

Pyrazolobenzimidazoles (GB 1 047 612), indazolones (U.S. Pat. No. 3,770,447) and pyrazolotriazoles (U.S. Pat. No. 3,725,067, GB 1 252 418 and Japanese Unexamined Patent Publications Nos. 16 548/1984 and 171 956/1984) have been proposed as magenta couplers with less side absorption at 430 nm. The side absorption of the image dyes formed from these couplers is substantially less so that the colour reproduction is considerably improved. Another advantage of these compounds is that they have much less tendency to turn yellow in the unexposed areas but against this is the disadvantage that the dyes produced have a relatively low stability to light.

There have therefore been numerous attempts in the past to improve the insufficient stability of the magenta dye to light, e.g. by a combination of 1H-pyrazolo-[3,2]-s-triazoles with phenols or phenol ethers (GB-A-2 135 788) or by a structural change of the magenta coupler (see Jp. Unexamined Patent Publication No. 43 659/1985).

The last-mentioned measure, however, generally produces a shift in the absorption maximum and an increase in the half band width (HBW).

There has been a drastic increase in recent years in the demands made on the stability to light of photographic materials.

It has now been found that hydroquinone ethers containing an additional sulphonamide group have an increased stabilizing effect on the magenta dyes formed from pyrazoloazole couplers.

The present invention relates to a colour photographic recording material containing at least one silver halide emulsion layer with which a magenta coupler is associated, characterised in that the magenta coupler corresponds to the following general formula I:

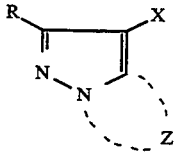

I wherein

R denotes H or a substituent;

X denotes H or a group which can be split off under the conditions of chromogenic development;

Z denotes the group required for completing a condensed nitrogen-containing ring;

and in that the layer containing the magenta coupler corresponding to formula I in addition contains at least one compound corresponding to the following general formula II

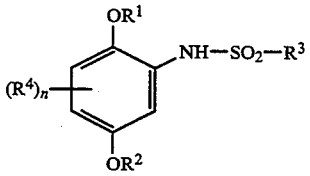

II wherein $R^1$, $R^2$ (identical or different) denote H, alkyl, aryl or a heterocyclic group; $R^1$ and/or $R^2$ may also combine with one of the groups $R^4$ to form a 5- to 7-membered heterocyclic ring containing at least one oxygen atom, $R^3$ denotes alkyl, alkenyl, aryl or a heterocyclic group;

$R^4$ denotes a substituent, e.g. halogen, CN, $NO_2$ or an organic radical such as, for example, alkyl, aryl, alkoxy, aryloxy, alkylthio, arylthio, amino, acylamino, sulphamido, carbamoyl, alkoxycarbonyl, sulphamoyl or alkyl- or arylsulphonyl; a group $R^4$ may also combine with another group $R^4$ or with $R^1$ or $R^2$ to form a 5- to 7-membered ring, e.g. a condensed benzene ring, or together with $R^1$ or $R^2$ it may form an oxygen-containing ring;

n stands for 0 or an integer from 1 to 3.

The magenta coupler of formula I used according to the invention may be derived, for example, from imidazolo [1,2-b]pyrazole, imidazolo[3,4-b]pyrazole, pyrazolo[2,3-b]-pyrazole, pyrazolo[3,2-c]-1,2,4-triazole, pyrazolo[2,3-b]-1,2,4-triazole, pyrazolo[2,3-c]-1,2,3-triazole or pyrazolo [2,3-d]tetrazole. The corresponding structures are those of formulae I-A to I-F shown below. Magenta couplers of the formulae I-C and I-D are preferred.

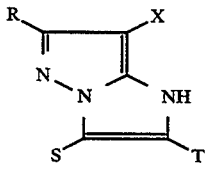

I-A

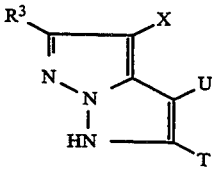

I-B

-continued

I-C

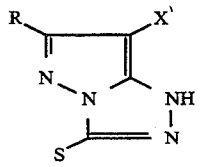

I-D

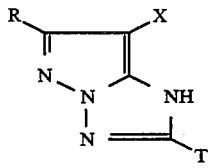

I-E

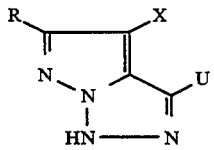

I-F

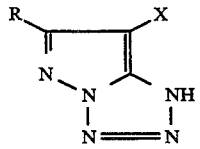

In the general formulae I-A to I-F, the substituents denoted by R, S, T and U are hydrogen, alkyl, aralkyl, aryl, alkoxy, aroxy, alkylthio, arylthio, amino, anilino, acylamino, cyano, alkoxycarbonyl, carbamoyl or sulphamoyl and these groups may be further substituted and in each of the formulae I-A to I-F at least one of the groups R, S, T and U is preferably of such a nature that the magenta coupler can be incorporated in a photographic layer in a diffusion fast form. The above-mentioned groups R, S, T and U may also contain a polymerisable double bond so that they may also be used in a polymerised form, for example as latex couplers. Such latex couplers are described inter alia in German Patent Application P 42 15 206.2.

X stands for hydrogen or a group which can be split off in the colour coupling reaction, such as a halogen atom or a preferably cyclic group attached to the coupling position by an oxygen atom, a sulphur atom or a nitrogen atom.

If the group which can be split off is a cyclic group, it may be attached to the coupling position of the coupler molecule either directly by an atom which forms part of a ring, e.g. a nitrogen atom, or indirectly by way of a linking member. Such removable groups are known in large numbers, e.g. as fugitive groups of 2-equivalent magenta couplers.

Examples of removable groups attached by oxygen correspond to the formula $$-O-R^5,$$

wherein $R^5$ stands for a cyclic or acyclic organic radical, e.g. alkyl, aryl, a heterocyclic group or acyl, which may be derived, for example, from an organic carboxylic or sulphonic acid. In particularly preferred removable groups of this type, $R^5$ is an optionally substituted phenyl group.

Examples of removable groups attached by nitrogen are described in the following German Offenlegungsschriften (DE-A-):

25 36 191, 27 03 589, 28 13 522, 33 39 201.

These groups are in many cases 5-membered heterocyclic rings which are attached to the coupling position of the magenta coupler by a ring nitrogen atom. The heterocyclic rings in many cases contain activating groups such as carbonyl or sulphonyl groups or double bonds adjacent to the nitrogen atom which provides the attachment to the coupler molecule.

If the removable group is attached to the coupling position of the coupler by a sulphur atom, the group may be the radical of a diffusible carbocyclic or heterocyclic mercapto compound which is capable of inhibiting the development of silver halide. Such inhibitor groups have frequently been described as removable groups attached to the coupling position of couplers, including magenta couplers, e.g. in U.S. Pat. No. 3,227,554.

Magenta couplers of formula I-C in which S stands for a substituent containing a hydroquinone ether group are particularly preferred. Couplers of this type are, for example, the subject of German Patent Application P 42 40 000.7 and correspond to formula I-L

I-L

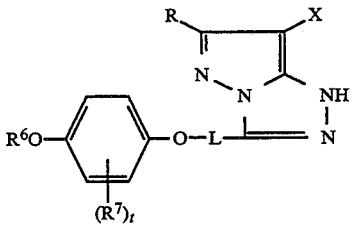

wherein X has the meaning indicated above and

R denotes alkyl;

$R^6$ denotes an alkyl group optionally substituted by OH, alkoxy, COOH or aryl;

$R^7$ denotes alkyl or aryl; or $R^6$ and $R^7$ together form a group for completing a 5-, 6- or 7-membered, optionally substituted ring;

t stands for 0 to 4;

L denotes a straight chain or branched alkylene group optionally interrupted by O.

Examples of suitable magenta couplers of formula I are shown below:

M-1
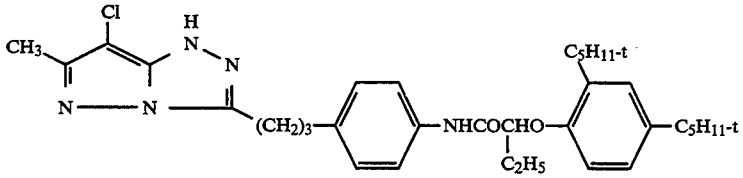
M-2
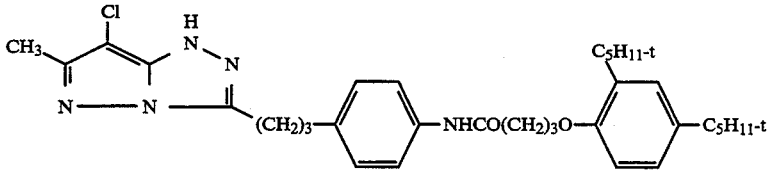
M-3
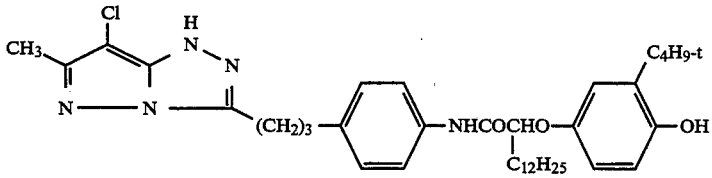
M-4
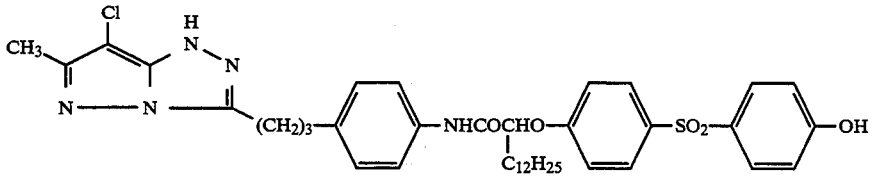
M-5
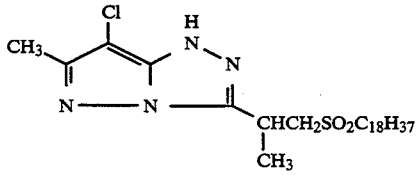
M-6
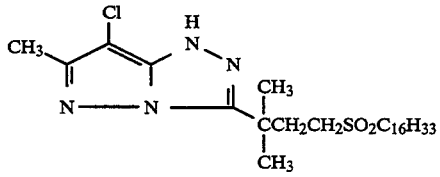
M-7
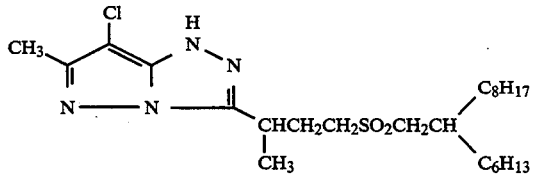
M-8
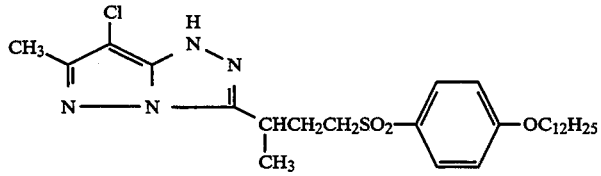
M-9
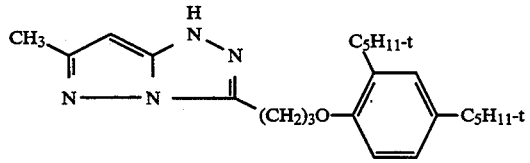

-continued
M-10
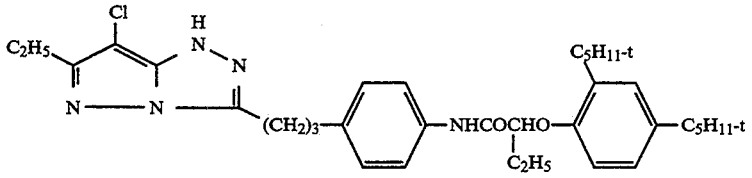
M-11
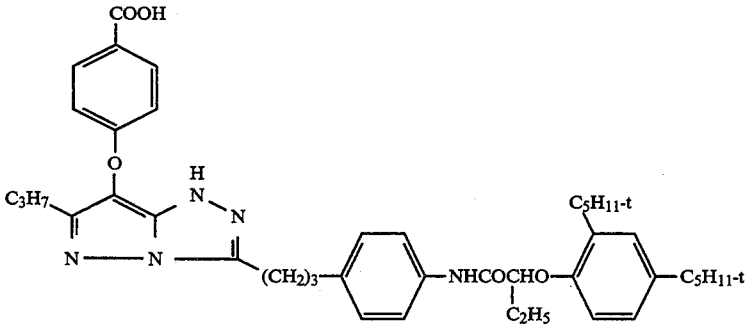
M-12
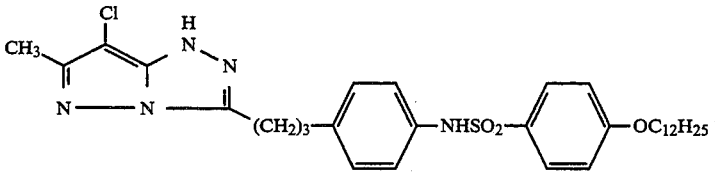
M-13
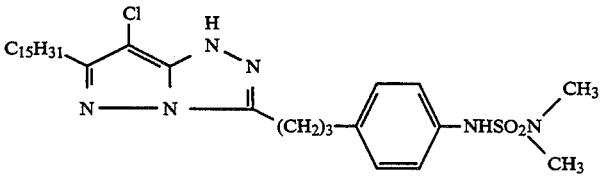
M-14
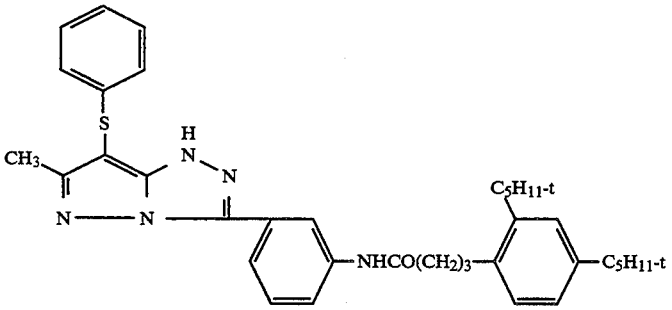
M-15
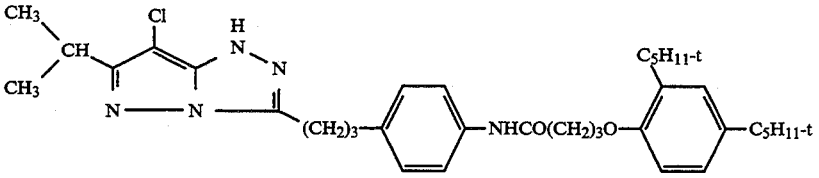
M-16
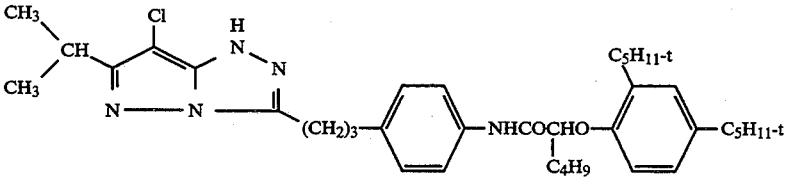

-continued
M-17
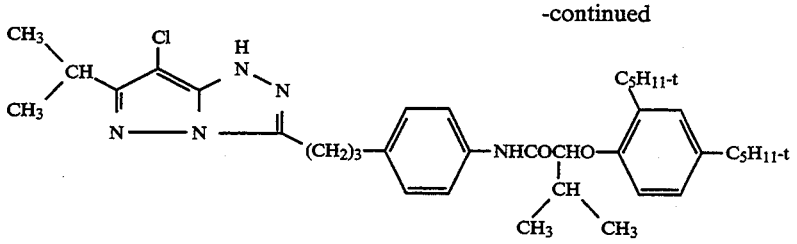
M-18
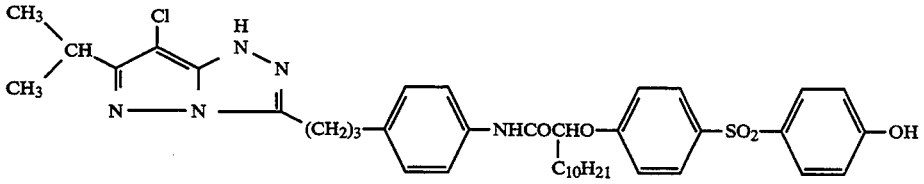
M-19
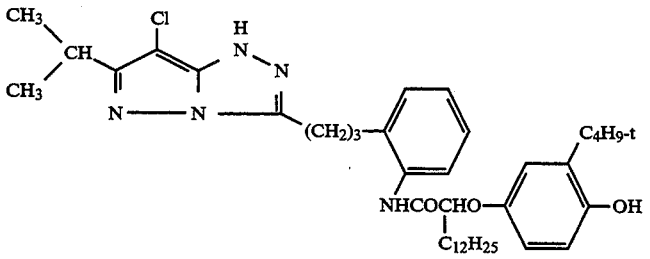
M-20
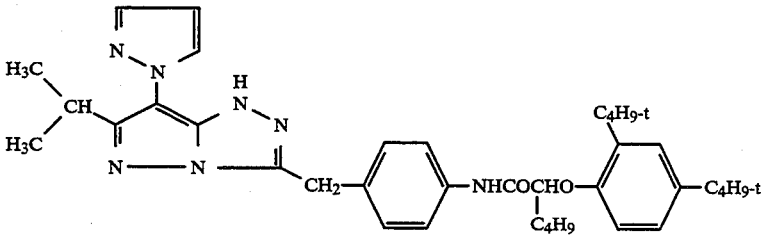
M-21
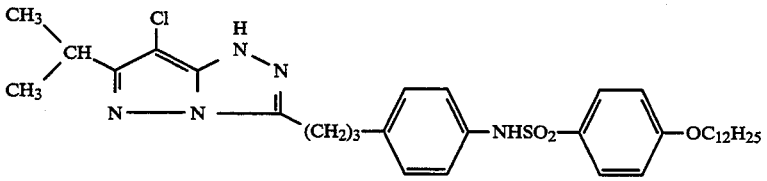
M-22
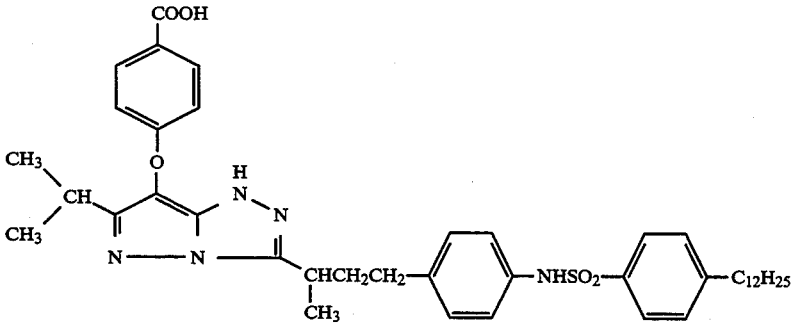
M-23
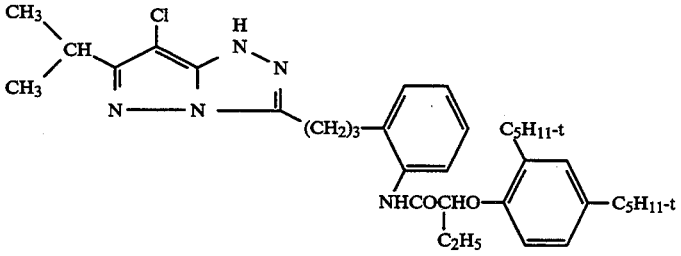

-continued
M-24
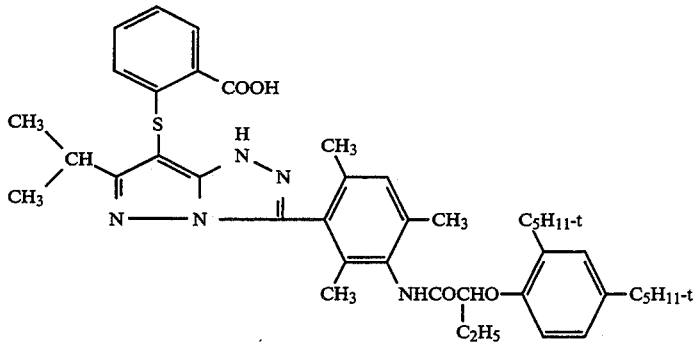
M-25
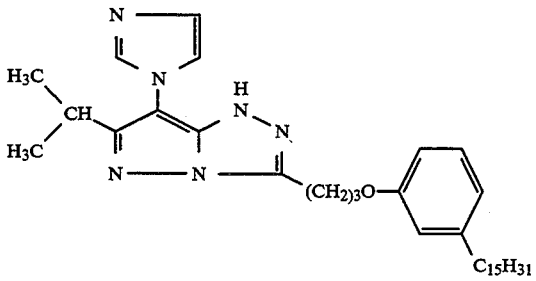
M-26
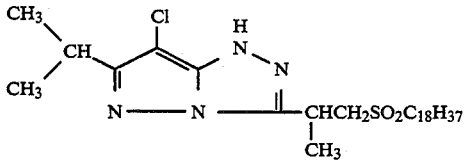
M-27
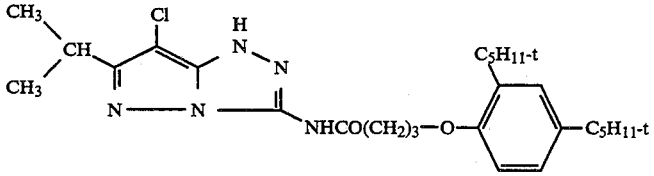
M-28
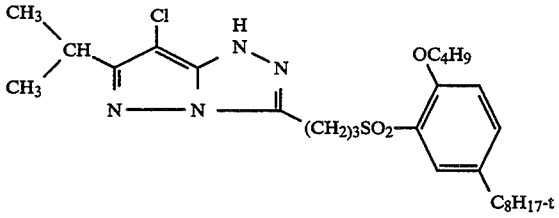
M-29
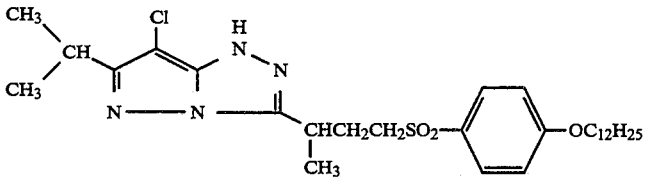
M-30
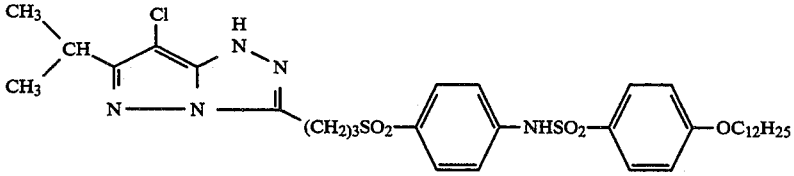

-continued
M-31
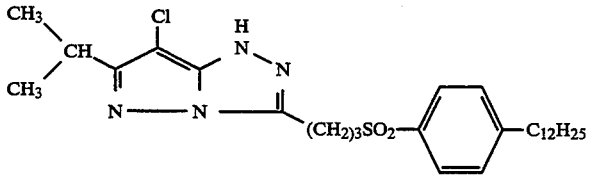
M-32
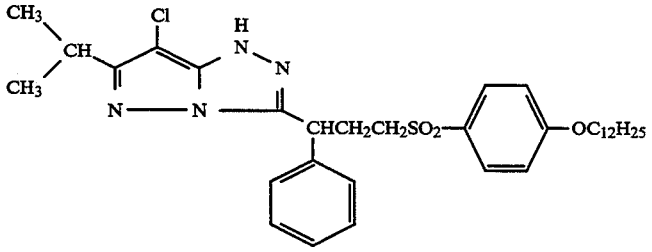
M-33
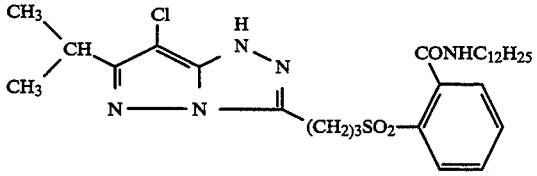
M-34
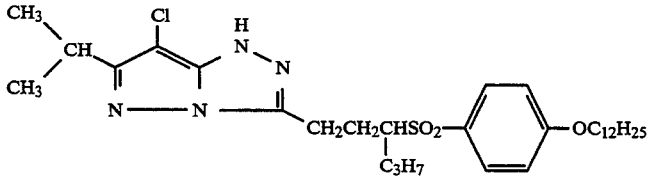
M-35
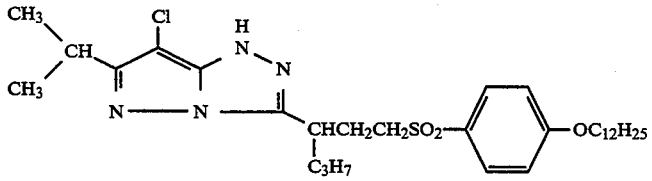
M-36
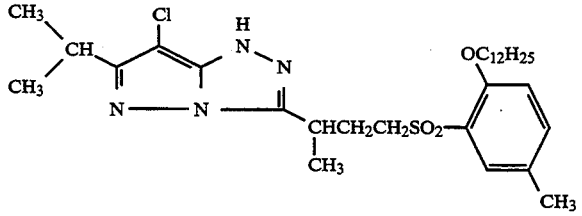
M-37
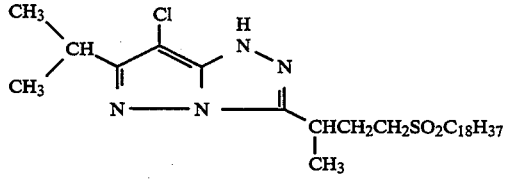
M-38
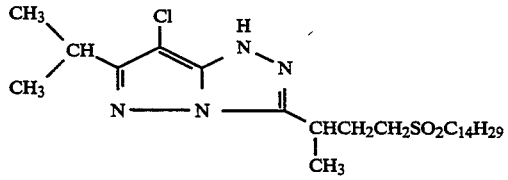

-continued
M-39
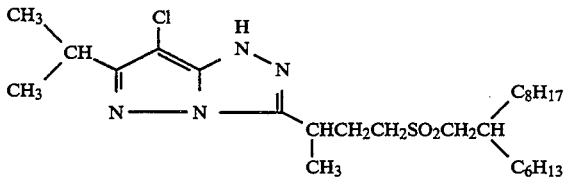
M-40
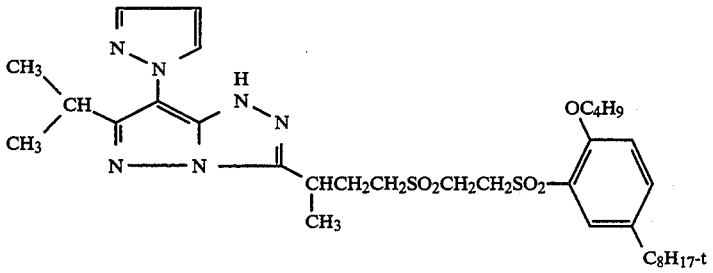
M-41
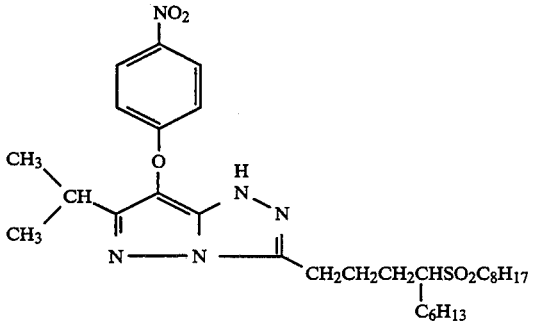
M-42
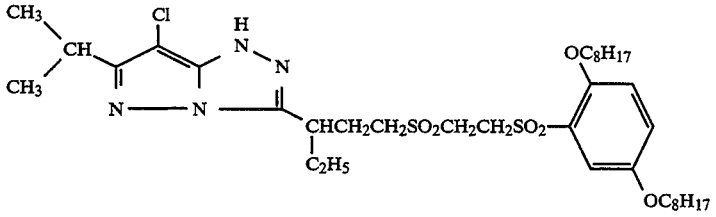
M-43
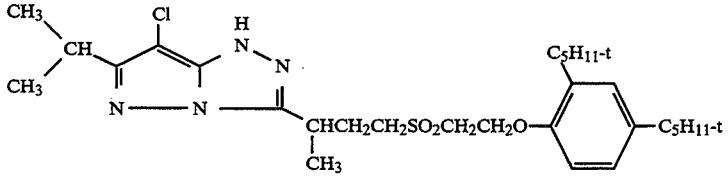
M-44
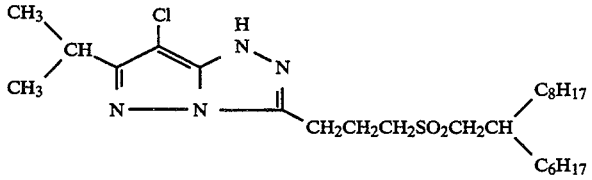
M-45
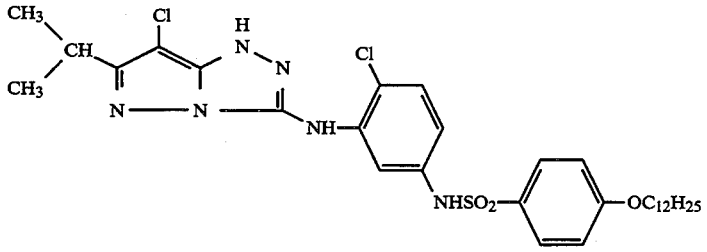

-continued
M-46
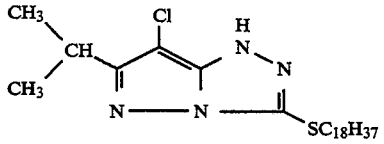
M-47
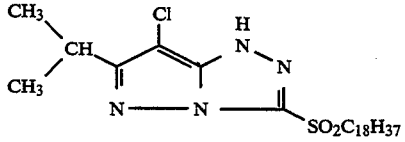
M-48
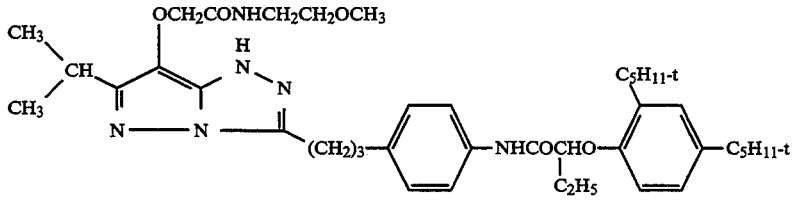
M-49
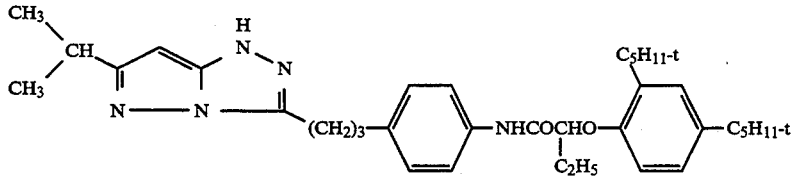
M-50
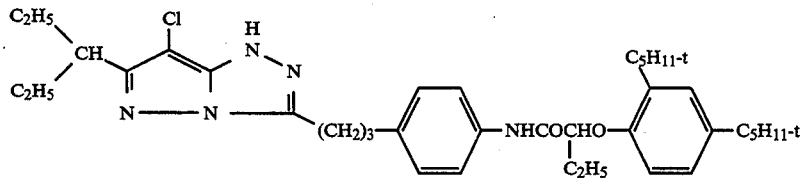
M-51
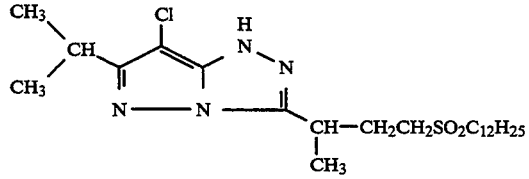
M-52
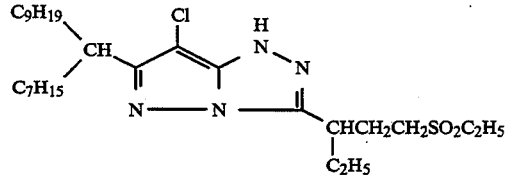
M-53
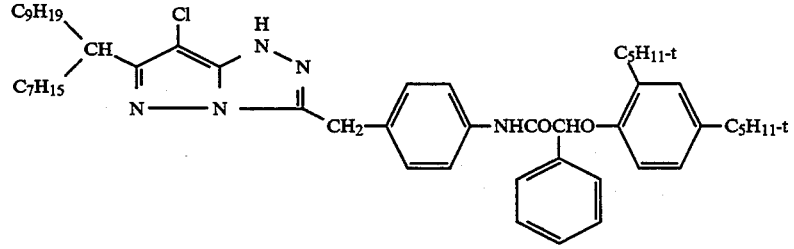

-continued
M-54
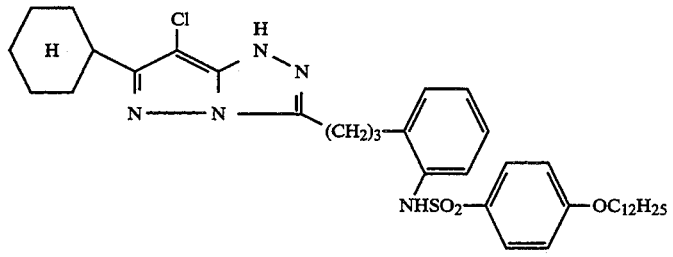
M-55
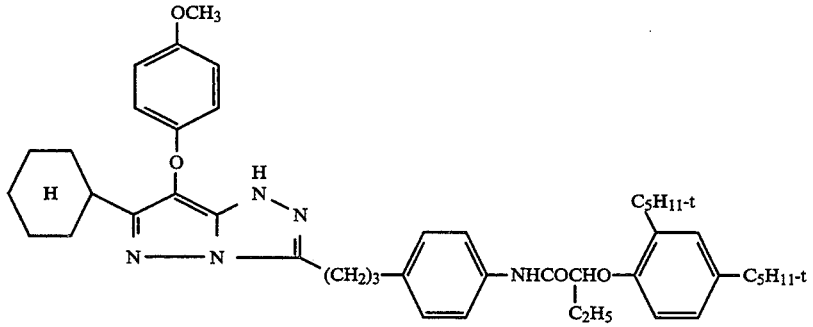
M-56
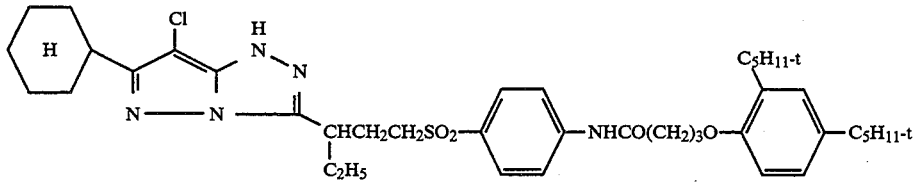
M-57
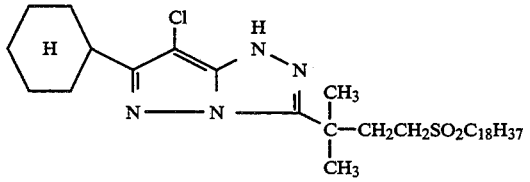
M-58
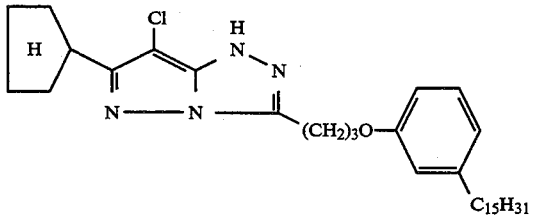
M-59
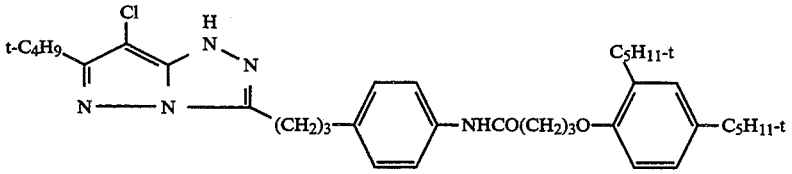
M-60
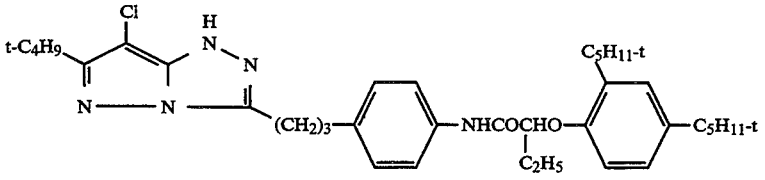

-continued
M-61
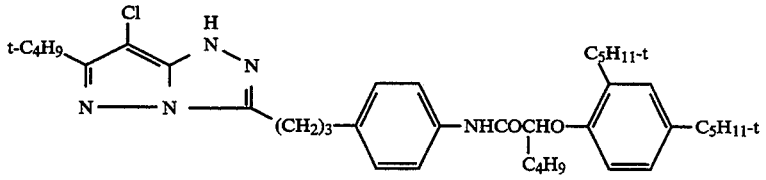
M-62
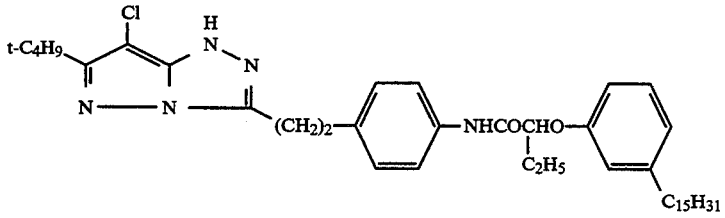
M-63
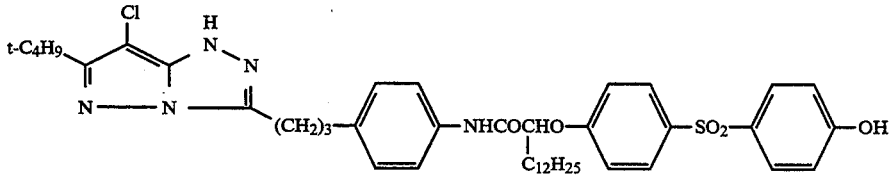
M-64
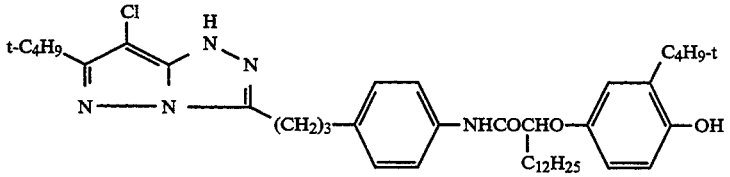
M-65
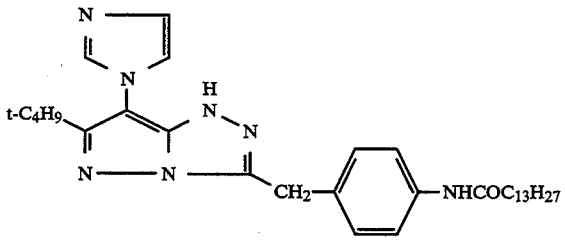
M-66
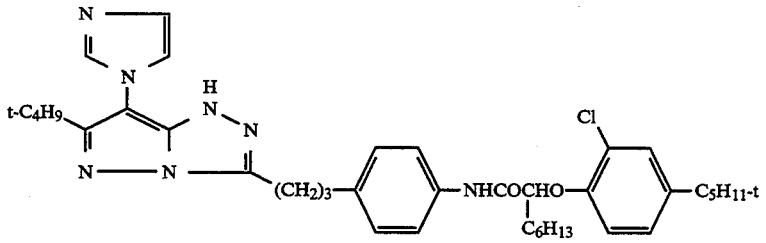
M-67
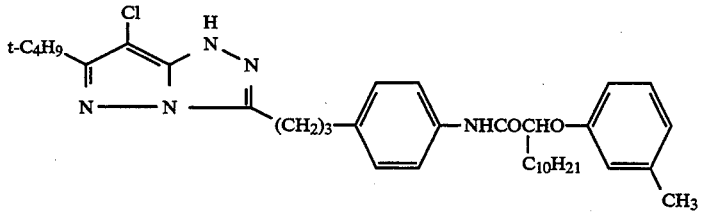
M-68
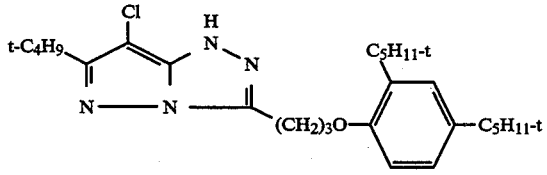

-continued
M-69
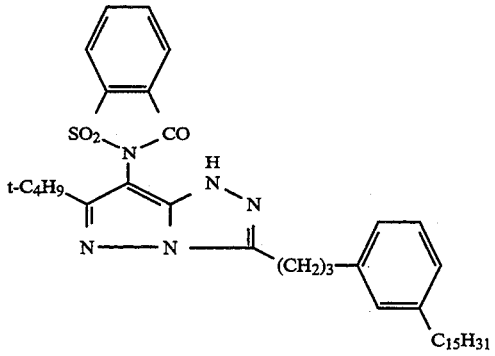
M-70
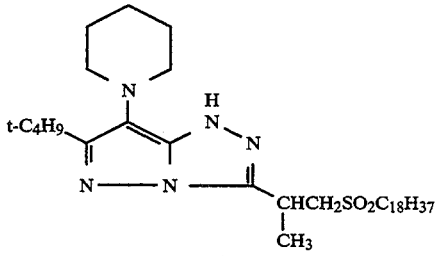
M-71
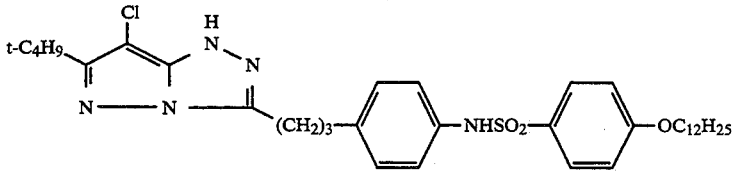
M-72
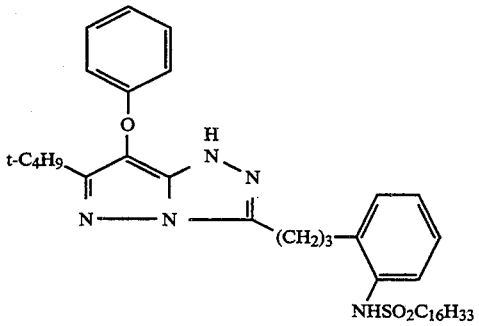
M-73
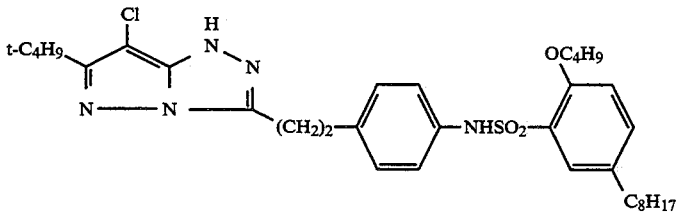
M-74
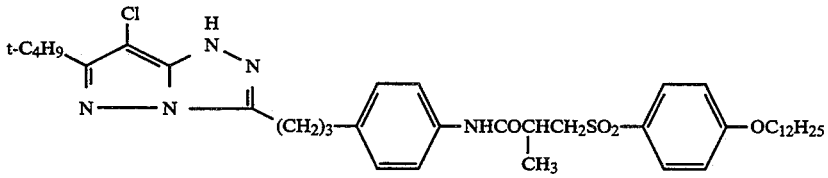

-continued
M-75
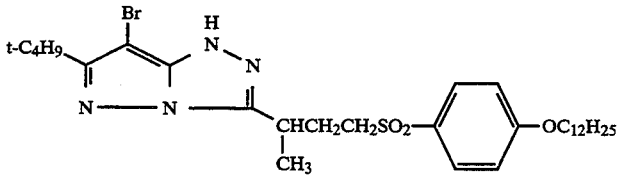
M-76
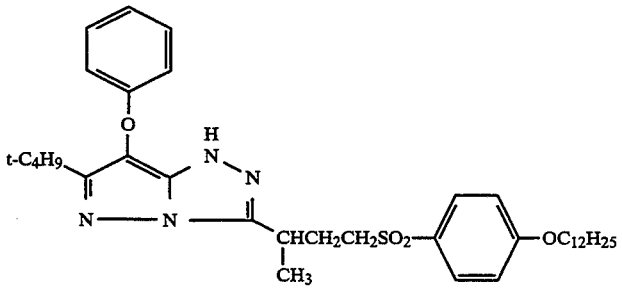
M-77
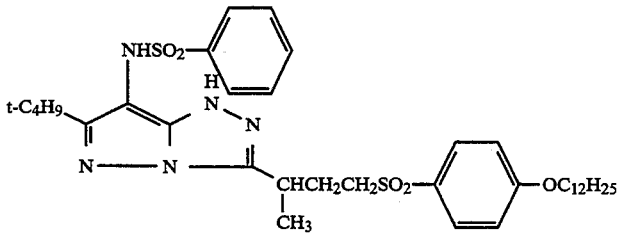
M-78
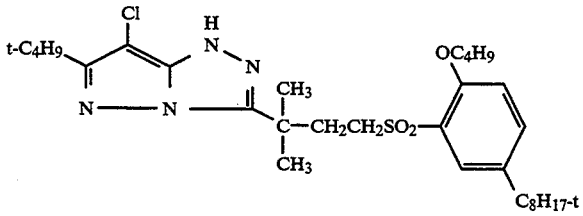
M-79
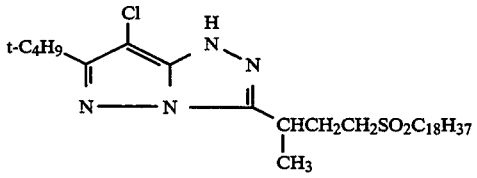
M-80
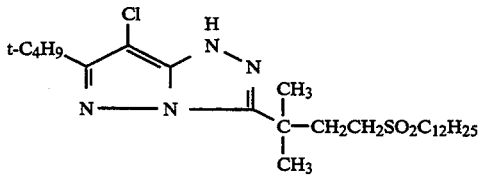
M-81
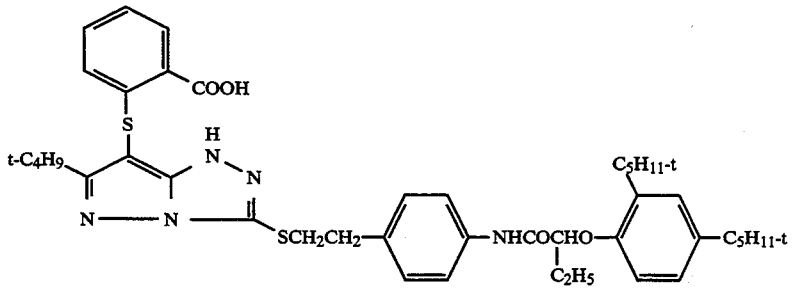

-continued
M-82
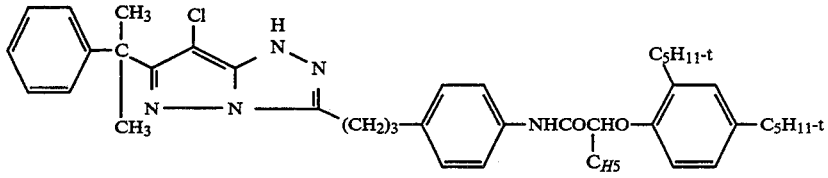
M-83
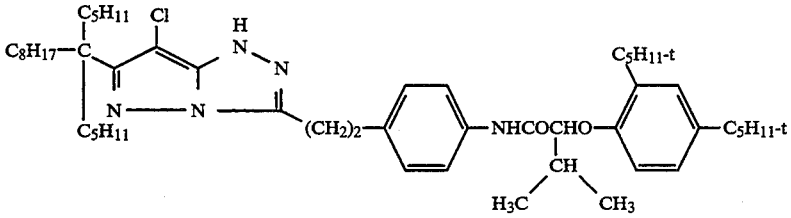
M-84
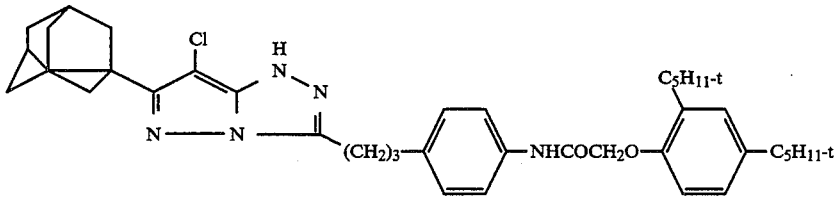
M-85
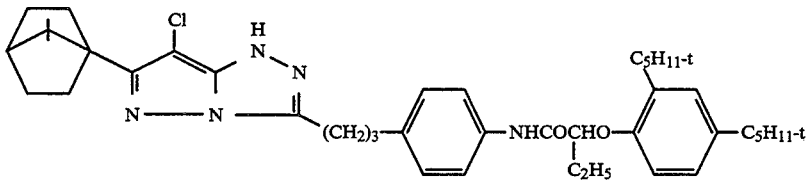
M-86
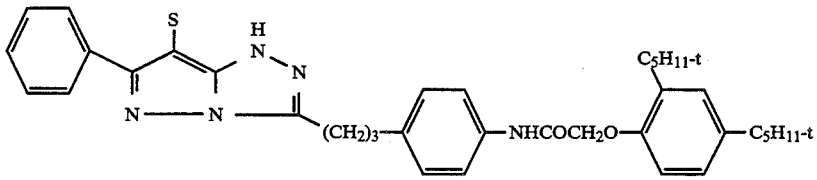
M-87
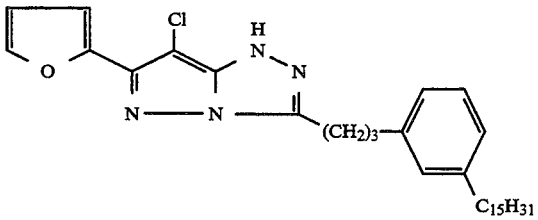
M-88
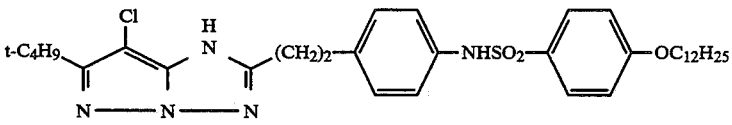
M-89
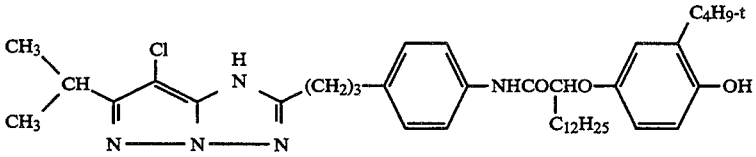

-continued
M-90
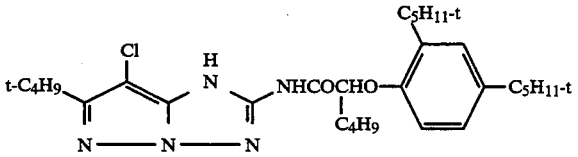
M-91
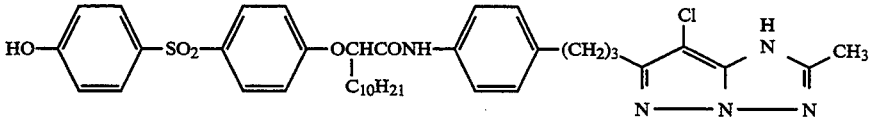
M-92
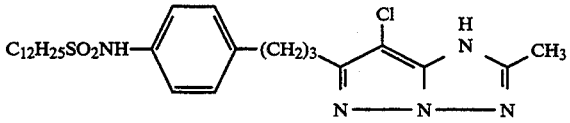
M-93
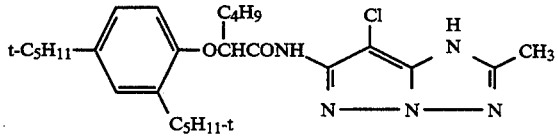
M-94
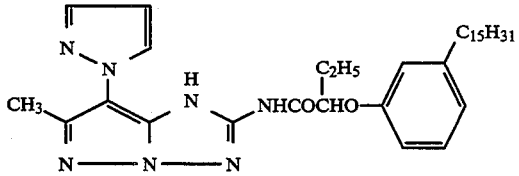
M-95
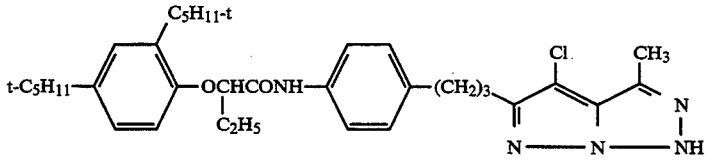
M-96
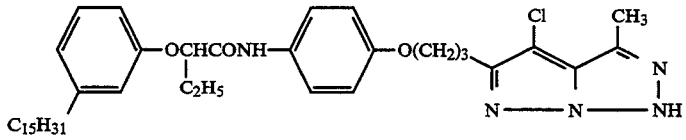
M-97
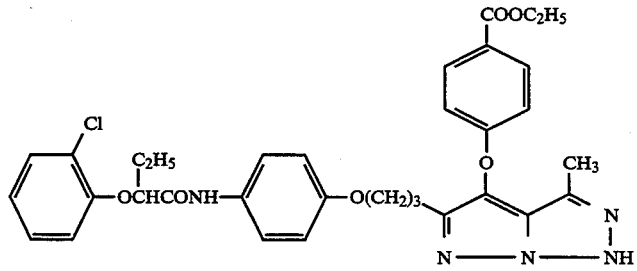
M-98
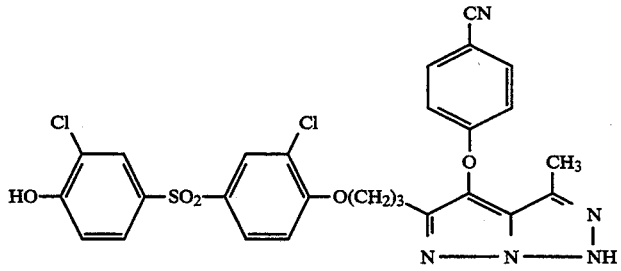

-continued
M-99
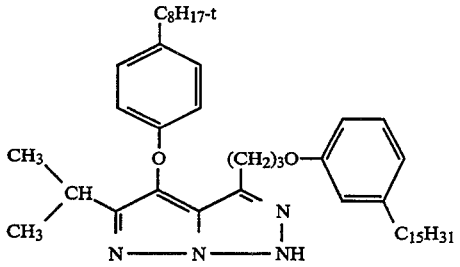
M-100
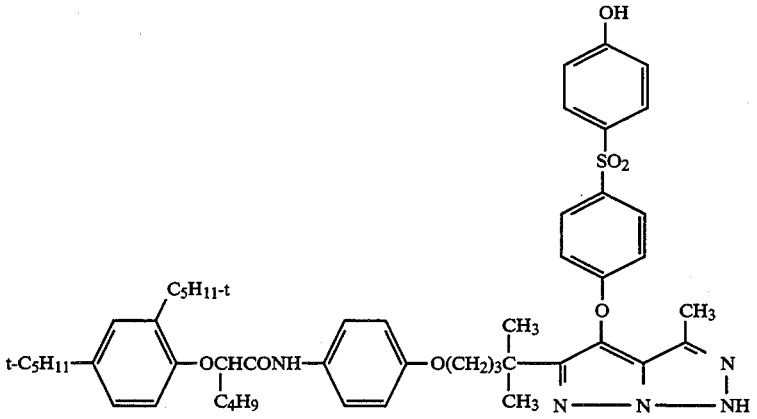
M-101
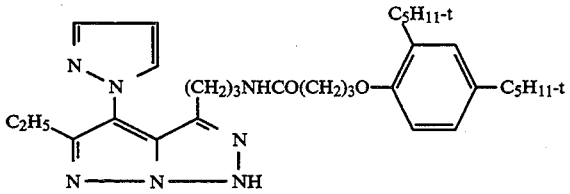
M-102
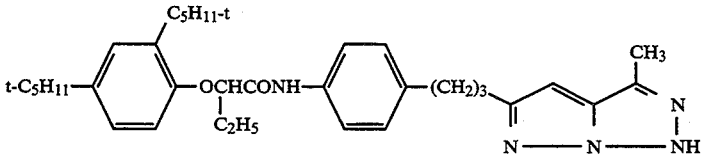
M-103
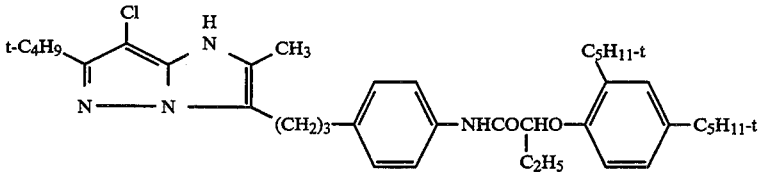
M-104
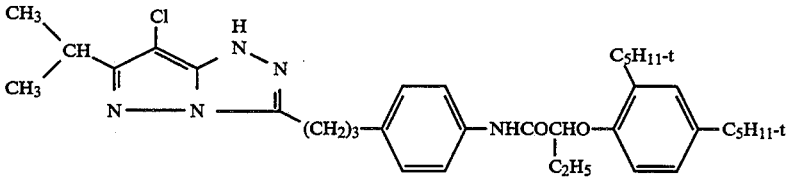
M-105
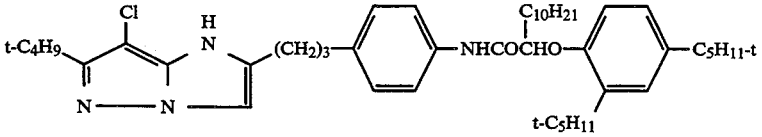

-continued
M-106
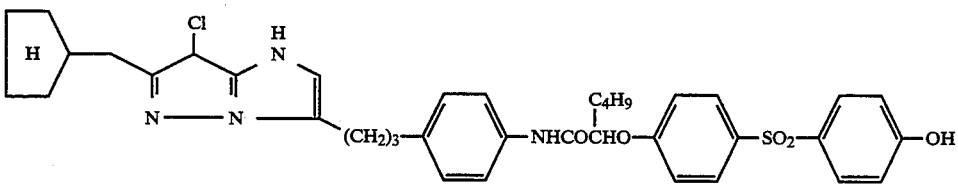
M-107
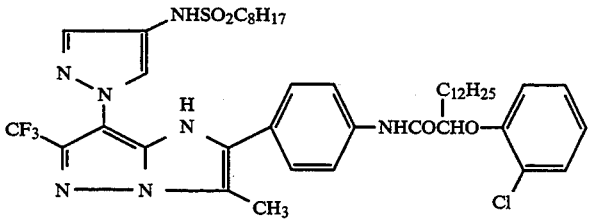
M-108
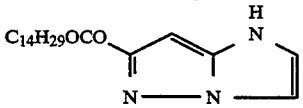
M-109
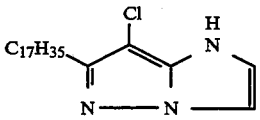
M-110
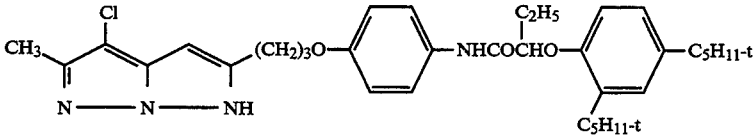
M-111
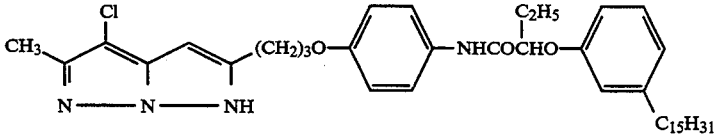
M-112
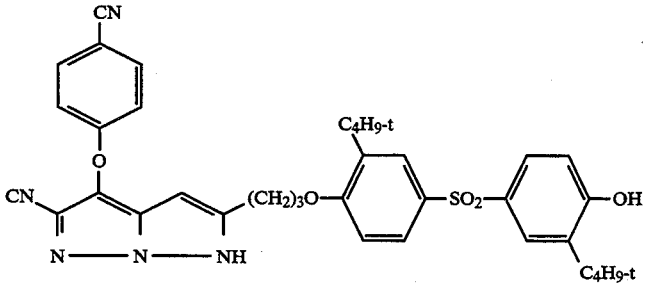
M-113
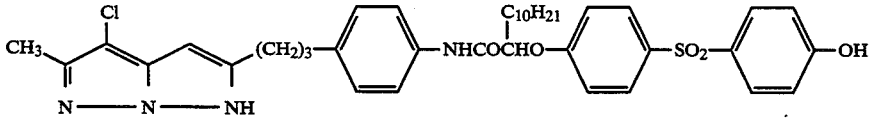
M-114
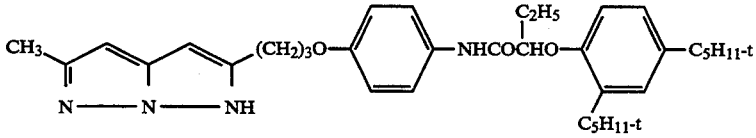

-continued

M-115

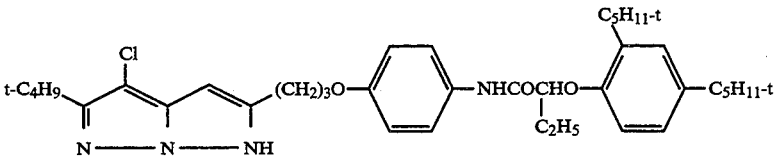

M-116

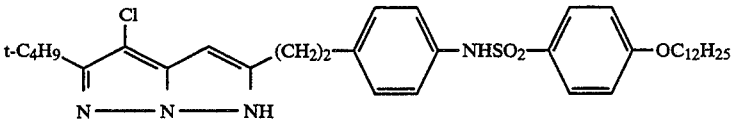

M-117

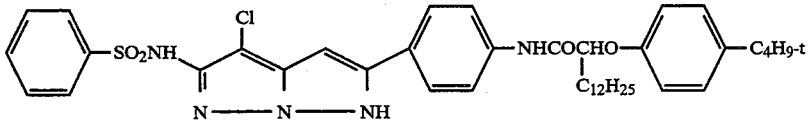

M-118

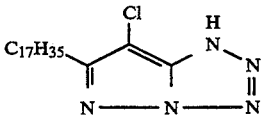

M-119

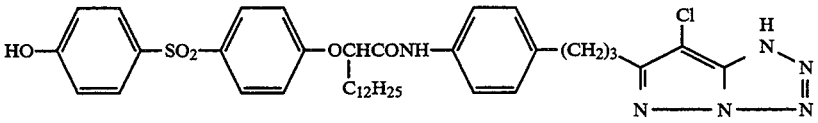

M-120

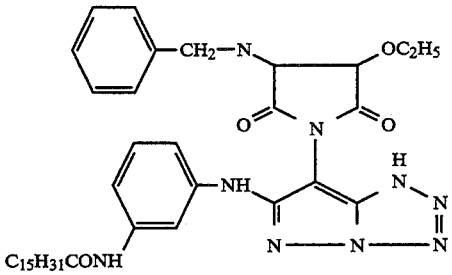

M-121

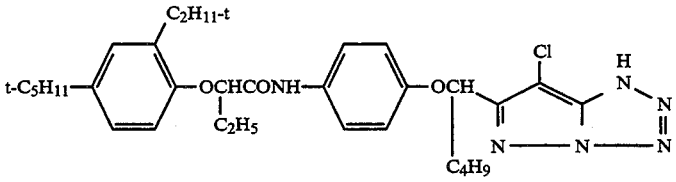

M-122

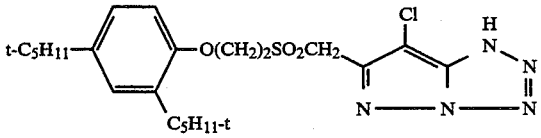

An alkyl group denoted by $R^1$ to $R^4$ in formula II or contained therein may be straight chain or branched, substituted or unsubstituted and contain up to 18 carbon atoms; examples are: Methyl, ethyl, propyl, isopropyl, butyl, tert.-butyl, tert.-amyl, hexyl, tert.-hexyl, octyl, dodecyl, hexadecyl; examples of substituents are: Halogen (e.g. fluorine, chlorine), hydroxy, alkoxy, alkoxycarbonyl and dialkylamino.

An aryl group denoted by $R^1$ to $R^4$ in formula II is in particular phenyl, optionally substituted e.g. with alkyl, alkoxy, acylamino or alkoxycarbonyl. Pyridyl is an example of a heterocyclic group.

Examples of stabilizer compounds according to the invention corresponding to formula II are shown below:

1

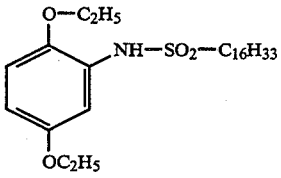

-continued
2
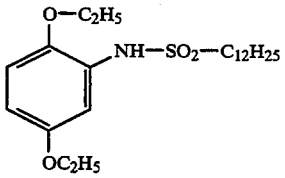
3
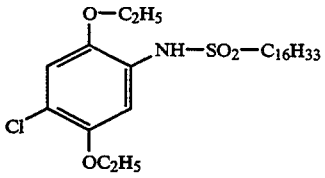
4
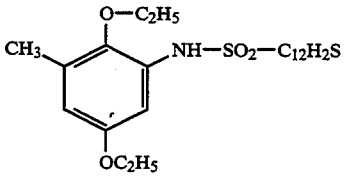
5
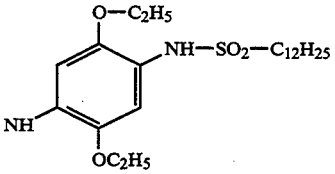
6
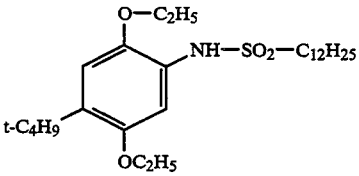
7
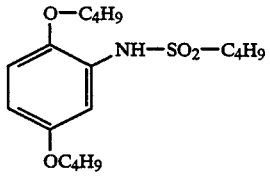
8
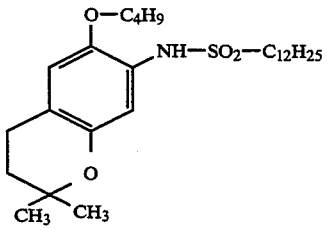
9
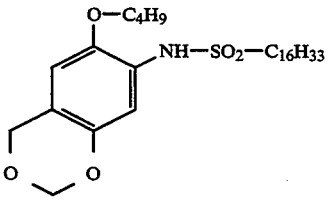
-continued
10
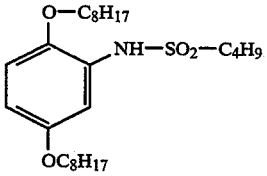
11
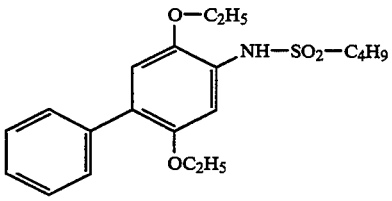
12
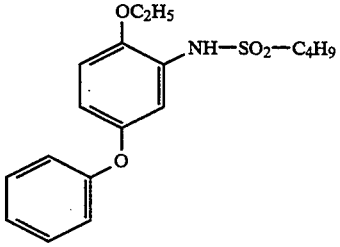
13
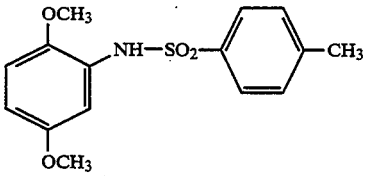
14
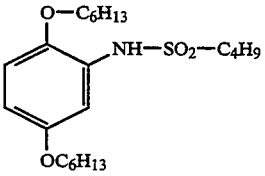
15
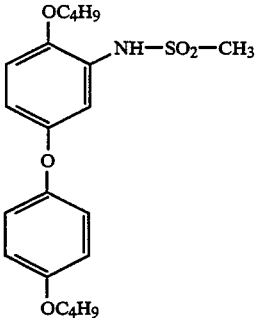
16
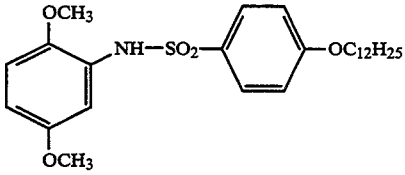

-continued
17
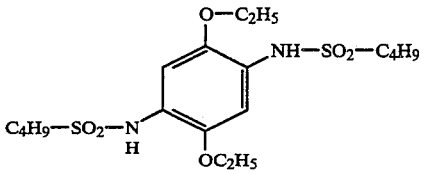
18
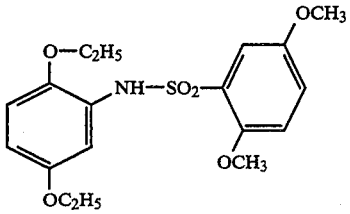
19
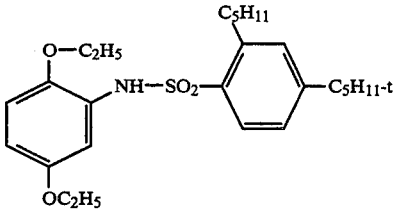
20
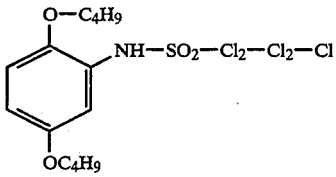
21
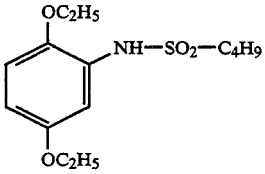
22
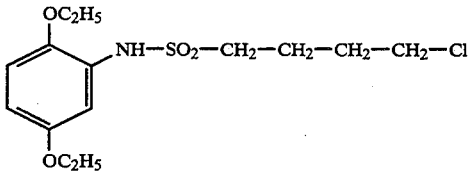
23
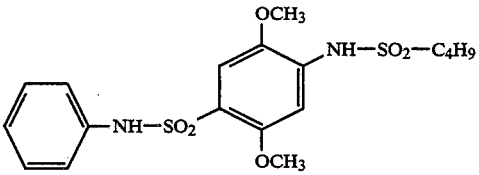
24
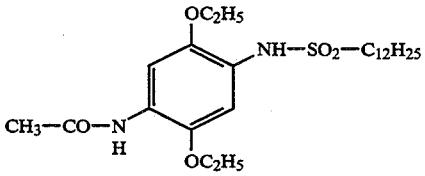
-continued
25
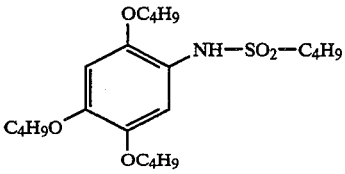
26
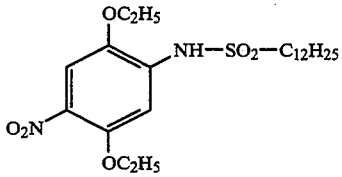
27
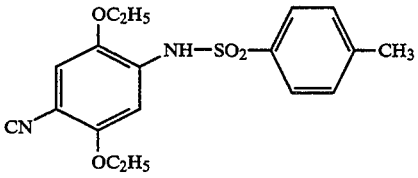
28
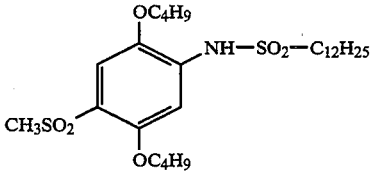
29
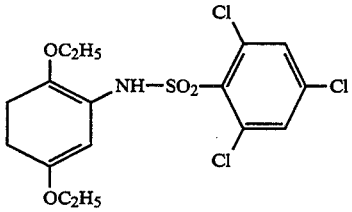
30
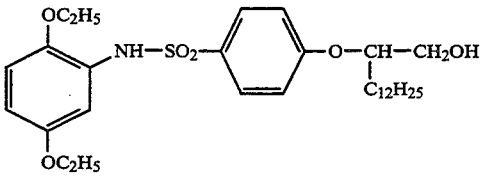
31
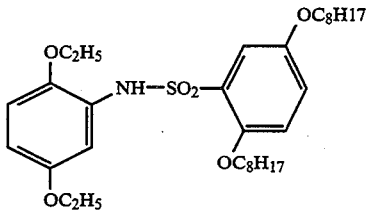
32
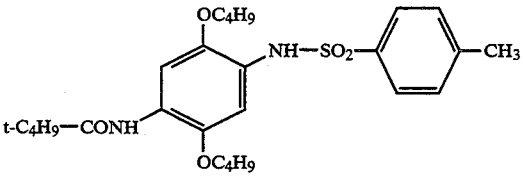

-continued
33
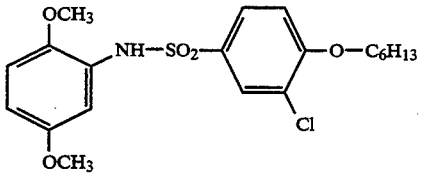
34
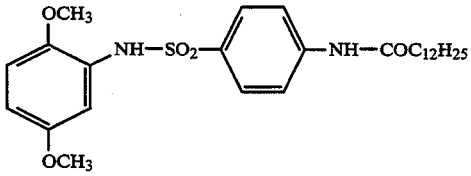
35
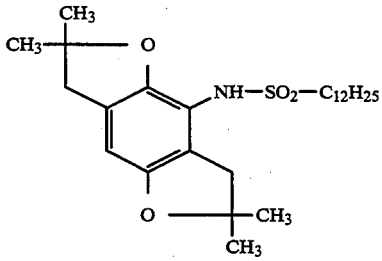
36
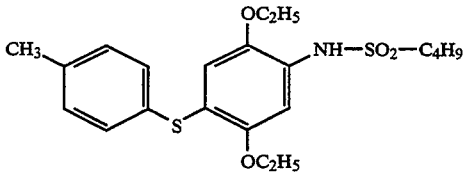
37
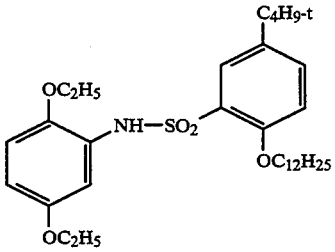
38
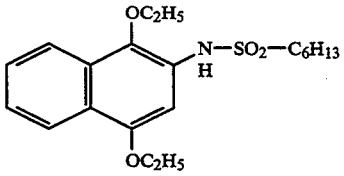
39
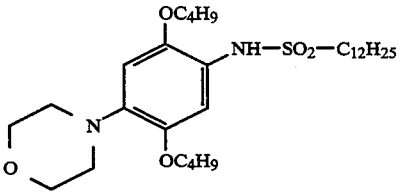
40
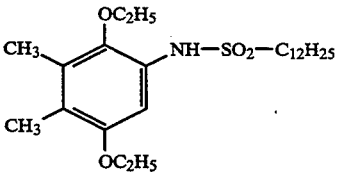
-continued
41
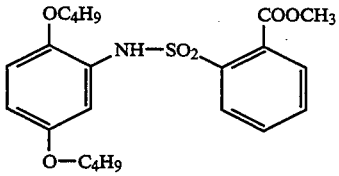
42
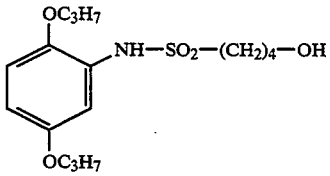
43
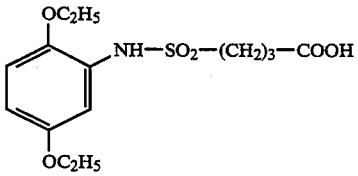
44
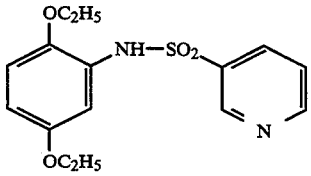
45
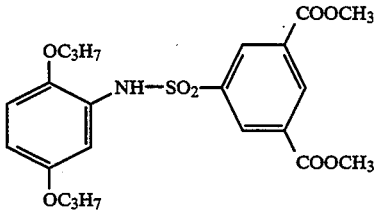
46
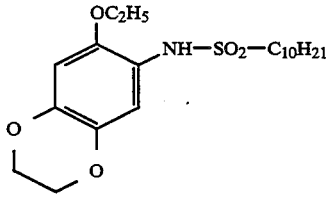
47
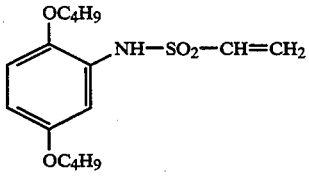
48
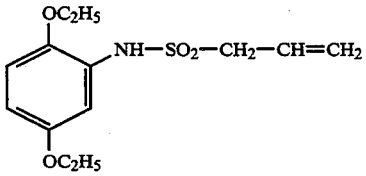
The stabilizer compounds according to the invention are obtainable by a single stage synthesis from commercially available precursors.

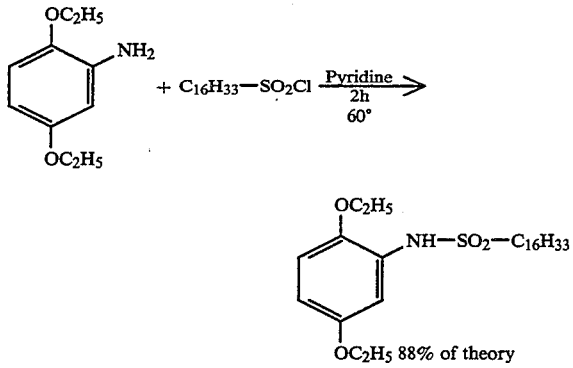

The stability to light of the magenta image dyes obtainable with the recording material according to the invention may be further improved by the addition of other stabilizers, e.g. compounds according to U.S. Pat. Nos. 5,108,886, 4,588,679, 4,735,893, organophosphorone antioxidants according to J. Prakt. Chem. 334 (1992), 333–349, singlett $O_2$ quenchers (see D. Bellus: Quenchers of Singulett Oxygen—a critical review in Singlet Oxygen Reactions with Organic compounds, B. Ranby, J. F. Rabek, John Wiley and Sons New York 1978, 61) or compounds described in GB-A-2 061 540, EP-A-0 098 241, Research Disclosure 34 367 (November 92/853) or in German Patent Application P 42 09 346.5 (filed on Mar. 3, 1992).

Additional improvement in stability to light may be achieved by the addition of the compounds according to the invention corresponding to formula II to combinations of pyrazoloazole couplers and light stabilizers according to EP-A-0 187 521,
DE-A-36 05 279,
EP-A-0 203 465,
EP-A-0 204 746,
EP-A-0 218 266 and
EP-A-0 234 783.

The compounds according to the invention also show very good improvement in the stability to light when used in combination with PVA layers.

Examples of colour photographic materials are in particular colour negative films, colour reversal films and colour photographic paper.

Suitable supports for the production of colour photographic materials are e.g. films and sheets of semi-synthetic or synthetic polymers such as cellulose nitrate, cellulose acetate, cellulose butyrate, polystyrene, polyvinyl chloride, polyethylene terephthalate and polycarbonate and paper laminated with a baryta layer or an α-olefin polymer layer (e.g. polyethylene). These supports may be coloured with dyes and pigments, for example titanium dioxide. The surface of the support is generally subjected to a treatment to improve the adherence of the photographic emulsion layer, for example a corona discharge followed by application of a subbing layer. A light reflecting support is preferred according to the invention.

Binders, silver halide grains and colour couplers are essential components of the photographic emulsion layers.

The binder used is preferably gelatine but this may be partly or completely replaced by other synthetic, semi-synthetic or naturally occurring polymers. Examples of synthetic gelatine substitutes include polyvinyl alcohol, poly-N-vinylpyrrolidone, polyacrylamides, polyacrylic acid and derivatives thereof, in particular their copolymers. Examples of naturally occurring gelatine substitutes include other proteins, such as albumin or casein, cellulose, sugar, starch and alginates. Semi-synthetic gelatine substitutes are generally modified natural products. Cellulose derivatives such as hydroxyalkyl cellulose, carboxymethyl cellulose and phthalyl cellulose and gelatine derivatives obtained by a reaction with alkylating or acylating agents or by grafting of polymerisable monomers are examples of these.

The binders should have a sufficient quantity of functional groups to be able to produce sufficiently resistant layers by a reaction with suitable hardeners. Examples of such functional groups are in particular amino groups but also carboxyl groups, hydroxyl groups and active methylene groups.

Gelatine, which is the binder preferably used, may be obtained by acid or alkaline decomposition. Oxidized gelatine may also be used. The preparation of such gelatines is described, for example, in The Science and Technology of Gelatine, published by A. G. Ward and A. Courts, Academic Press 1977, page 295 et seq. The gelatine used should contain as little photographically impurities as possible (inert gelatine). Gelatines having a high viscosity and low swelling are particularly advantageous.

The halide in the silver halide present as light sensitive component of the photographic material may be chloride, bromide or iodide or mixtures of these. For example, the halide component of at least one layer may consist of 0 to 15 mol-% of iodide, 0 to 100 mol-% of chloride and 0 to 100 mol-% of bromide. The silver halide emulsions in colour negative and colour reversal films are normally silver iodobromide emulsions and those in colour negative and colour reversal paper are normally silver chlorobromide emulsions with a high chloride content up to pure silver chloride emulsions. Silver halide emulsions in which 95 mol-% or more, preferably 99 mol-% or more of the halide content is chloride are preferred according to the invention. These silver halides may be predominantly compact crystals which may have e.g. regular cubic or octahedral or transitional forms, but platelet shaped crystals having an average ratio of diameter to thickness of preferably at least 5:1 may also advantageously be present, the diameter of a grain being defined as the diameter of a circle having a surface area equal to the projected surface area of the grain. The layers may also contain tabular silver halide crystals in which the ratio of diameter to thickness is substantially greater than 5:1, e.g. from 12:1 to 30:1.

The silver halide grains may also have a multilayered grain structure, in the simplest case with an inner and an outer region (core/shell) which differ from one another in the halide composition and/or by other modifications, e.g. doping. The average grain size of the emulsions is preferably from 0.2 μm to 2.0 μm and the grain size distribution may be either homodisperse or heterodisperse. A homodisperse grain distribution means that 95% of the grains deviate by not more than ±30% from the average grain size.

Two or more types of silver halide emulsions which have been prepared separately may be used as a mixture.

The emulsions may be chemically or spectrally sensitized in the usual manner and the emulsion layers as well as other, light-insensitive layers may be hardened in the usual manner with known hardeners, in particular with hardeners which activate carboxyl groups, such as carbamoyl pyridinium salts (e.g. according to DE-A-22 25 230, DE-A-23 17 677 and DE-A-24 39 551).

Colour photographic silver halide materials conventionally contain at least one silver halide emulsion layer for each of the three spectral regions, red, green and blue. The photographic emulsions may be spectrally sensitized for this purpose, using methine dyes or other dyes. Cyanine dyes, merocyanine dyes and complex merocyanine dyes are particularly suitable.

A survey of polymethine dyes suitable as spectral sensitizers, suitable combinations thereof and combinations which have a supersensitizing action is given in Research Disclosure 17643 (December 1978), Chapter IV.

Suitable dyes are in particular the following, arranged according to the spectral regions:

1. As red sensitizers

9-Ethylcarbocyanines containing benzothiazole, benzoselenazole or naphthothiazole as basic end groups which may be substituted by halogen, methyl, methoxy, carbalkoxy or aryl in the 5- and/or 6-position, and 9-ethyl-naphthoxathia- and -selenacarbocyanines and 9-ethyl-naphthothioxa- and -benzimidazocarbocyanines, provided the dyes carry at least one sulphoalkyl group on the heterocyclic nitrogen atom.

2. as green sensitizers

9-Ethylcarbocyanines containing benzoxazole, naphthoxazole or a benzoxazole and a benzothiazole as basic end groups, and benzimidazocarbocyanines which may also be further substituted and must also contain at least one sulphoalkyl group on the heterocyclic nitrogen.

3. as blue sensitizers symmetric or asymmetric benzimidazo-, oxa-, thia- or selena-cyanines having at least one sulphoalkyl group on the heterocyclic nitrogen and optionally further substituents on the aromatic nucleus, and apomerocyanines containing a rhodanine group.

Sensitizers may be omitted if the intrinsic sensitivity of the silver halide is sufficient for a particular spectral region, for example the blue sensitivity of silver bromides.

The variously sensitized emulsion layers are associated with non-diffusible, low molecular weight or polymeric colour couplers which may be situated in the same layer or in an adjacent layer. Cyan couplers are normally associated with the red sensitive layers, magenta couplers with the green sensitive layers and yellow couplers with the blue sensitive layers.

Colour couplers for producing the cyan partial colour image are generally couplers of the phenol or α-naphthol series; suitable examples of these correspond to formulae III, IV, V or VI:

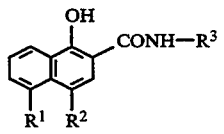

(III)

C-1: $R^1$, $R^2$ = H; $R^3$ = —$(CH_2)_3$—O— 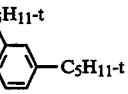 —$C_5H_{11}$-t

-continued

C-2: $R^1$ = —$NHCOOCH_2$—$CH(CH_3)_2$; $R^2$ = H; $R^3$ = —$(CH_2)_3$—$OC_{12}H_{25}$

C-3: $R^1$ = H; $R^2$ = —$OCH_2$—$CH_2$—$SO_2CH_3$; $R_3$ = —$C_{16}H_{33}$;

C-4: $R^1$ = H; $R^2$ = —$OCH_2$—CONH—$(CH_2$—$OCH_3$; $R^3$ = —$(CH_2)_4$—O— 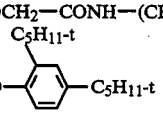 —$C_5H_{11}$-t C-5: $R^1$, $R^2$ = H; $R^3$ = —$(CH_2)_4$—O— 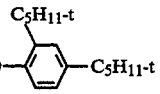 —$C_5H_{11}$-t C-6: $R^1$, $R^2$ = H; $R^3$ = —$(CH_2)_4$—O— 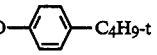 —$C_4H_9$-t

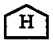

C-7: $R^1$ = H; $R^2$ = Cl; $R^3$ = —$C(C_2H_5)_2$—$C_{21}H_{43}$

C-8: $R^1$ = H; $R^2$ = —O—$CH_2$—$CH_2$—S—CH(COOH)—$C_{12}H_{25}$ $R^3$ = Cyclohexyl (IV)

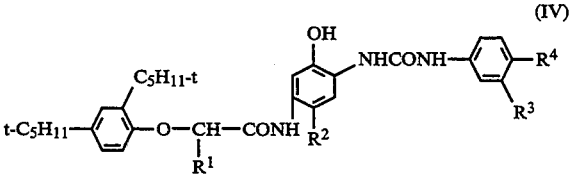

C-9: $R^1$ = —$C_4H_9$; $R^2$ = H; $R^3$ = —CN; $R^4$ = Cl

C-10: $R^1$ = —$C_4H_9$; $R^2$ = H; $R^3$ = H; $R^4$ = —$SO_2CHF_2$

C-11: $R^1$ = —$C_4H_9$; $R^2$ = —O— 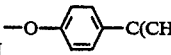 —$C(CH_3)_2$—$CH_2$—$C(CH_3)_3$; $R^3$ = H; $R^4$ = —CN

C-12: $R^1$ = $C_2H_5$; $R^2$, $R^3$ = H; $R^4$ = —$SO_2CH_3$

C-13: $R^1$ = —$C_4H_9$; $R^2$, $R^3$ = H; $R^4$ = —$SO_2$—$C_4H_9$

C-14: $R^1$ = —$C_4H_9$; $R^2$ = H; $R^3$ = —CN; $R^4$ = —CN

C-15: $R^1$ = —$C_4H_9$; $R^2$, $R^3$ = H; $R^4$ = —$SO_2$—$CH_2$—$CHF_2$

C-16: $R^1$ = —$C_2H_5$; $R^2$, $R^3$ = H; $R^4$ = —$SO_2CH_2$—CHF—$C_3H_7$

C-17: $R^1$ = —$C_4H_9$; $R^2$, $R^3$ = H; $R^4$ = F

C-18: $R^1$ = —$C_4H_9$; $R^2$, $R^3$ = H; $R^4$ = —$SO_2CH_3$

C-19: $R^1$ = —$C_4H_9$; $R^2$, $R^3$ = H; $R^4$ = —CN (V)

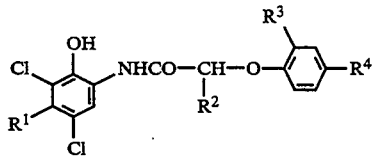

C-20: $R^1$ = —$CH_3$; $R^2$ = —$C_2H_5$; $R^3$, $R^4$ = —$C_5H_{11}$-t

C-21: $R^1$ = —$CH_3$; $R^2$ = H; $R^3$, $R^4$ = —$C_5H_{11}$-t

C-22: $R^1$, $R^2$ = $C_2H_5$; $R^3$, $R^4$ = —$C_5H_{11}$-t

C-23: $R^1$ = $C_2H_5$; $R^2$ = —$C_4H_9$; $R^3$, $R^4$ = —$C_5H_{11}$-t

C-24: $R^1$ = —$C_2H_5$; $R^2$ = —$C_4H_9$; $R^3$, $R^4$ = —$C_4H_9$-t

-continued (VI)

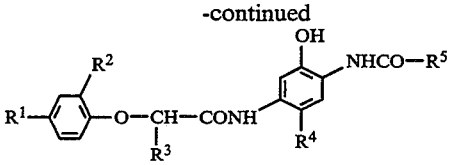

C-25: $R^1$, $R^2$ = $-C_5H_{11}$-t; $R^3$ = $-C_4H_9$; $R^4$ = H; $R^5$ = $-C_3F_7$

C-26: $R^1$ = $-NHSO_2-C_4H_9$; $R^2$ = H; $R^3$ = $-C_{12}H_{25}$; $R^4$ = Cl; $R^5$ = phenyl C-27: $R^1$, $R^2$ = $-C_5H_{11}$-t; $R^3$ = $-C_3H_7$-i; $R^4$ = Cl; $R^5$ = pentafluorophenyl C-28: $R^1$ = $-C_5H_{11}$-t; $R^2$ = Cl; $R^3$ = $-C_6H_{13}$; $R^4$ = Cl; $R^5$ = —2-chlorophenyl Phenolic cyan couplers which carry a ballasted acylamino group in the 2-positon and an ethyl group in the 5-position are preferred as cyan couplers in the recording material according to the invention, e.g. couplers of formula V wherein $R^1$ stands for ethyl and $R^2$, $R^3$ and $R^4$ stand for alkyl.

For producing the magenta partial colour image, the recording material of the present invention contains at least one magenta coupler of formula I, e.g. a magenta coupler of one of the formulae M-1 to M-122. Colour couplers for producing the yellow partial colour image are generally couplers containing an open chain ketomethylene group, in particular couplers of the α-acylacetamide series; suitable examples of these are α-benzoyl-acetanilide couplers and α-pivaloyl acetaniline couplers (formula VII).

(VII)

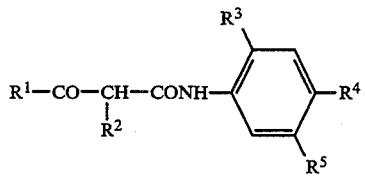

Y-1:

$R^1$ = $-C_4H_9$-t;

$R^2$ = 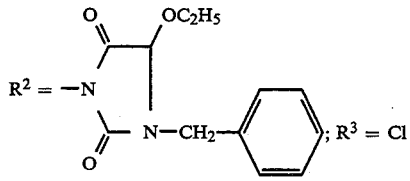 ; $R^3$ = Cl $R^4$ = H;

$R^5$ = 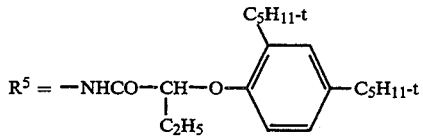

Y-2:

$R^1$ = $-C_4H_9$-t;

$R^2$ = 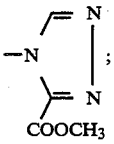 ; $R^3$ = $-OC_{16}H_{33}$; $R^4$ = H;

$R^5$ = $-SO_2NHCH_3$

Y-3:

$R^1$ = $-C_4H_9$-t;

$R^2$ = 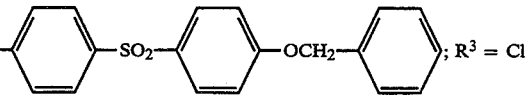 ; $R^3$ = Cl $R^4$ = H; $R^5$ = $-NHSO_2-C_{16}H_{33}$

Y-4:

$R^1$ = $-C_4H_9$-t;

-continued
$R^2 =$ 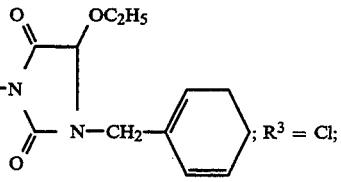 ; $R^3 = Cl$;
$R^4 = H$; $R^5 = -COOC_{12}H_{25}$
Y-5:
$R^1 = -C_4H_9$-t;
$R^2 =$ 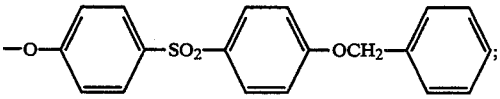 ; $R^3 = Cl$;
$R^4 = H$; $R^5 =$ 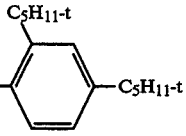
Y-6:
$R^1 = -C_4H_9$-t;
$R^2 =$ 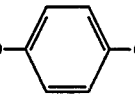 ; $R^3 = Cl$; $R^4 = H$;
$R^5 =$ 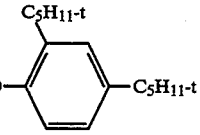
Y-7:
$R^1 = -C_4H_9$-t;
$R^2 =$ 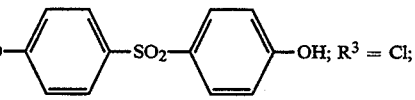 ; $R^3 = Cl$;
$R^4 = H$; $R^5 = -NHSO_2-C_{16}H_{33}$
Y-8:
$R^1 = -C_4H_9$-t;
$R^2 =$ 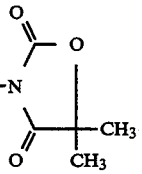 ; $R^3 = Cl$; $R^4 = H$;
$R^5 =$ 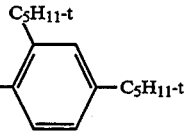
Y-9:
$R^1 = -C_4H_9$-t;

-continued
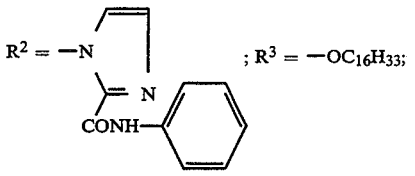
; $R^3 = -OC_{16}H_{33}$;
$R^4 = H$; $R^5 = -SO_2NHCOC_2H_5$
Y-10:
$R^1 = -C_4H_9$-t;
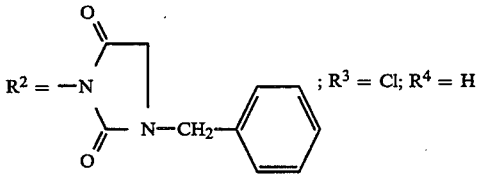
; $R^3 = Cl$; $R^4 = H$
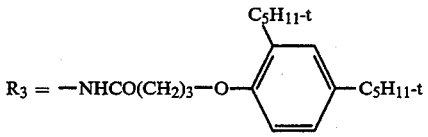
Y-11:
$R^1 = -C_4H_9$-t;
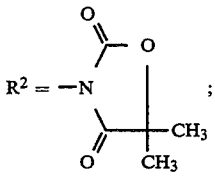
; $R^3 = Cl$; $R^4 = H$;
$R^5 = -COOCH(C_4H_9)-COOC_{12}H_{25}$
Y-12:
$R^1 = C_4H_9$-t;
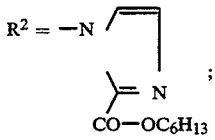
; $R^3 = Cl$; $R^4 = H$;
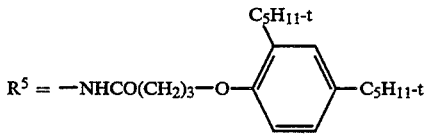
Y-13:
$R^1 = -C_4H_9$-t;
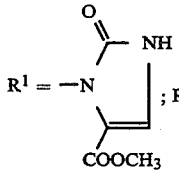
; $R^3 = -OC_{16}H_{33}$; $R^4 = H$;
$R^5 = -SO_2NHCH_3$ -continued
$R^5$ = 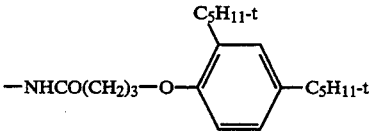
Y-14:
$R^1$ = $-C_4H_9$-t;
$R^2$ = 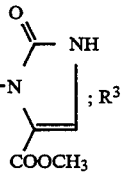 ; $R^3$ = Cl; $R^4$ = H;
$R^5$ = 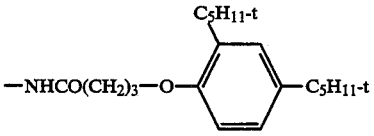
Y-15:
$R^1$ = 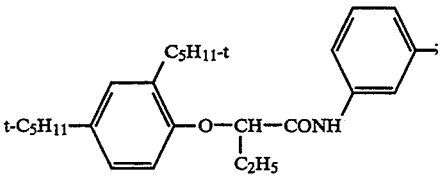
$R^2$, $R^4$, $R^5$= H; $R^3$ = $-OCH_3$
Y-16:
$R^1$ = 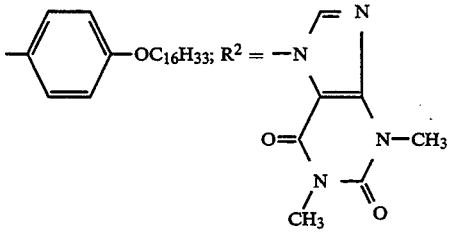
$R^3$, $R^5$ = $-OCH_3$; $R^4$ = H
Y-17:
$R^1$ = 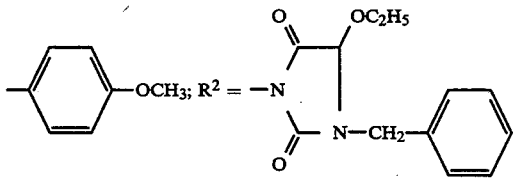
$R^3$ = Cl; $R^4$ = H; $R^5$ = $-COOC_{12}H_{25}$
Y-18:

-continued

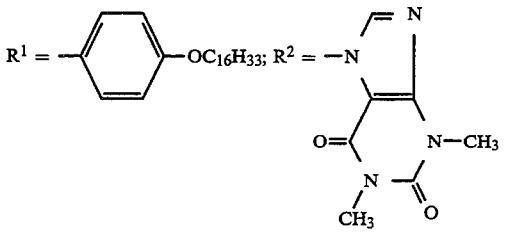

$R^3$ = Cl; $R^4$, $R^5$ = $-OCH_3$

Y-19:

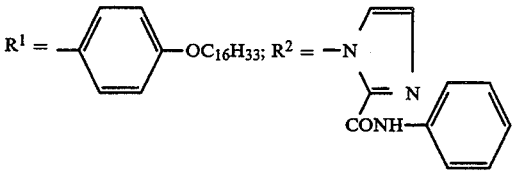

$R^3$ = $-OCH_3$; $R^4$ = H; $R^5$ = $-SO_2N(CH_3)_2$

Y-20:

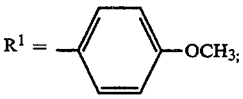

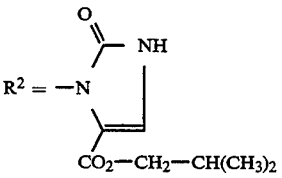

$R^3$ = $-OCH_3$; $R^4$ = H;

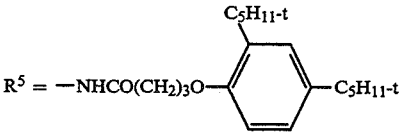

The yellow couplers used in the recording material according to the invention are preferably pivaloyl acetanilide yellow couplers, e.g. couplers of formula VII wherein $R^1$ stands for tertiary butyl, $R^2$ for a leaving group, $R^3$ for chlorine or alkoxy, $R^4$ for H and $R^5$ for acylamino, sulphonamido, sulphamoyl or alkoxycarbonyl.

The colour couplers may be 4-equivalent couplers or 2-equivalent couplers. The latter are derived from 4-equivalent couplers by containing, in the coupling position, a substituent which is split off in the coupling reaction. 2-Equivalent couplers include couplers which are colourless as well as couplers which have an intense colour of their own which disappears in the process of colour coupling and is replaced by the colour of the image dye produced (masking couplers), and white couplers which give rise to substantially colourless products in the reaction with colour developer oxidation products. 2-Equivalent couplers also include those couplers which carry in the coupling position a removable group which is released in the reaction with colour developer oxidation products and develops a particular desired photographic effect, e.g. as development inhibitor or accelerator, either directly or after one or more further groups have been split off from the group originally split off, (e.g. DE-A-27 03 145, DE-A-28 55 697, DE-A-31 05 026, DE-A-33 19 428). The known DIR couplers as well as DAR and FAR couplers are examples of such 2-equivalent couplers.

The following are examples of white couplers:

W-1

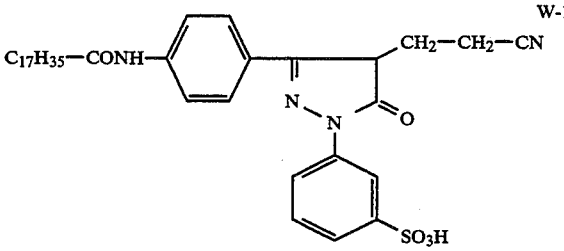

-continued

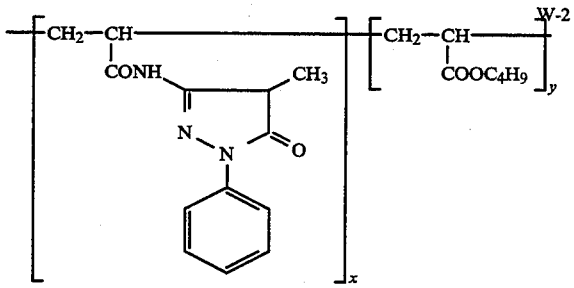

W-2

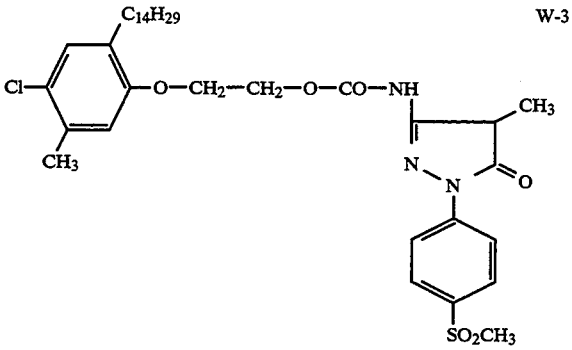

W-3

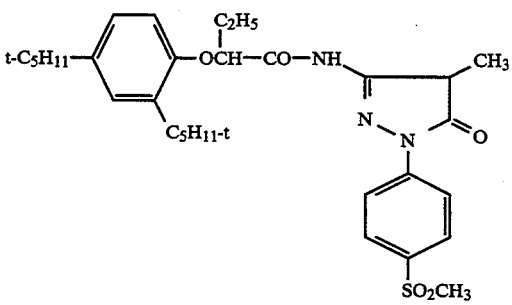

W-4

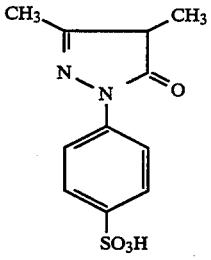

W-5

DIR couplers which release development inhibitors of the azole series, e.g. triazoles or benzotriazoles, are described in DE-A-24 14 006, 26 10 546, 26 59 417, 27 54 281, 28 42 063, 36 26 219, 36 30 564, 36 36 824 and 36 44 416. Other advantages for colour reproduction, i.e. colour separation and colour purity, and for reproduction of detail,. i.e. sharpness and graininess, can be obtained with DIR couplers which, for example, do not split off the development inhibitor directly as a result of the coupling reaction with an oxidised colour developer but only after a subsequent reaction which is achieved, for example, with a time control group. Examples are described in DE-A-28 55 697, 32 99 671, 38 18 231, 35 18 797, EP-A-0 157 146 and 0 204 175, U.S. Pat. Nos. 4,146,396 and 4,438,393 and in GB-A-2 072 363.

For increasing the sensitivity, contrast and maximum density it is particularly suitable to use DAR and FAR couplers which split off a development accelerator or a fogging agent. Compounds of this type are described, for example, in DE-A-25 34 466, 32 09 110, 33 33 355, 34 10 616, 34 29 545 and 34 41 823, in EP-A-0 089 834, 0 110 511, 0 118 087 and 0 147 765 and in U.S. Pat. Nos. 4,618,572 and 4,656,123.

For an example of the use of BAR couplers (Bleach Accelerator Releasing Coupler), see EP-A-193 389.

It may be advantageous to modify the effect of a photographically active group split off from a coupler by enabling this group to enter into an intermolecular reaction with another group after its release, as described in DE-A-35 06 805.

The removable group may also be a ballast group so that the reaction with colour developer oxidation products gives rise to coupling products which are diffusible or at least have a weak or limited mobility (U.S. Pat. No. 4,420,556).

The material may also contain compounds which are not couplers but are capable of releasing, for example, a development inhibitor, a development accelerator, a bleaching accelerator, a developer, a silver halide solvent, a fogging agent or an anti-foggant, for example so-called DIR hydroquinones and other compounds described, for example, in U.S. Pat. Nos.4,636,546, 4,345,024 and 4,684,604, in DE-A-31 45 640, 25 15 213 and 24 47 079 and in EP-A-198 438. These compounds fulfil the same function as the DIR, DAR or FAR couplers except that they form no coupling products.

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and U.S. Pat. No. 4,080,211. The high molecular weight colour couplers are generally prepared by polymerisation of ethylenically unsaturated monomeric colour couplers but they may also be obtained by polyaddition or polycondensation.

The incorporation of couplers or other compounds in silver halide emulsion layers may be carried out by first preparing a solution, dispersion or emulsion of the particular compound and then adding this to the casting solution for the layer in which it is required. The choice of suitable solvents or dispersing agents depends on the solubility of the compound.

Methods of introducing substantially water-insoluble compounds by grinding are described, for example, in DE-A-26 09 741 and DE-A-26 09 742.

Hydrophobic compounds may also be introduced into the casting solution by means of high boiling solvents, so-called oil formers. Suitable methods are described, for example, in U.S. Pat. Nos. 2,322,027, 2,801,170, 2,801,171 and EP-A-0 043 037. Suitable oil formers for the magenta couplers according to the invention are described, for example, in DE-A-39 18 547.

So-called polymeric oil formers, which may be oligomers or polymers, may be used instead of the high boiling solvents.

The compounds may also be introduced into the casting solution in the form of charged latices; see, for example, DE-A-25 41 230, DE-A-25 41 274, DE-A-28 35 856, EP-A-0 014 921, EP-A-0 069 671, EP-A-0 130 115 and U.S. Pat. No. 4,291,113.

The diffusion-fast incorporation of anionic, water-soluble compounds (e.g. dyes) may also be carried out by means of cationic polymers, so-called mordant polymers.

Examples of suitable oil formers include phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

The following are examples of suitable oil formers: Dibutyl phthalate, dicyclohexyl phthalate, di-2-ethylhexyl-phthalate, decyl phthalate, triphenyl phosphate, tricresyl phosphate, 2-ethylhexyl-diphenyl phosphate, tricyclohexyl phosphate, tri-2-ethylhexyl phosphate, tridecyl phosphate, tributoxyethyl phosphate, trichloropropyl phosphate, di-2-ethylhexyl-phenyl phosphate, 2-ethylhexyl benzoate, dodecyl benzoate, 2-ethylhexyl-p-hydroxybenzoate, diethyl dodecanamide, N-tetradecylpyrrolidone, isostearyl alcohol, 2,4-di-t-amylphenol, dioctyl acetate, glycerol tributyrate, isostearyl lactate, trioctyl citrate, N,N-dibutyl-2-butoxy-5-t-octylaniline, paraffin, dodecylbenzene and diisopropyl naphthalene.

Each of the variously sensitized light-sensitive layers may consist of a single layer or comprise two or more silver halide emulsion partial layers (DE-C-1 121 470). Red sensitive silver halide emulsion layers are frequently arranged closer to the layer support than green-sensitive silver halide emulsion layers which in turn are arranged closer to the support than blue-sensitive layers, and a light-insensitive yellow filter layer is generally placed between the green-sensitive layers and the blue-sensitive layers.

If the intrinsic sensitivity of the green- or red-sensitive layers is sufficiently low, the yellow filter layer may be omitted and different layer arrangements may be chosen. A recording material containing, as lowermost light-sensitive layer on a light reflecting support, a blue-sensitive layer with yellow coupler, above this a green-sensitive layer with the combination according to the invention of a pyrazoloazole coupler and a light stabilizer of formula II and, as uppermost light-sensitive layer, a red-sensitive layer containing a phenolic cyan coupler is preferred according to the invention.

The light-insensitive interlayers generally arranged between layers differing in spectral sensitivity may contain agents for preventing unwanted diffusion of developer oxidation products form one light-sensitive layer into another light-sensitive layer having a different spectral sensitization.

Suitable agents, also known as scavengers or EOP acceptors, are described in Research Disclosure 17643 (December 1978), Chapter VII, 17842 (February 1979) and 18716 (November 1979), page 650, and in EP-A-0 069 070, 0 098 072, 0 124 877 and 0 125 522.

The following are examples of particularly suitable compounds:

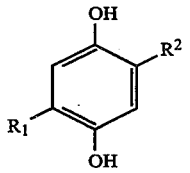

$R_1, R_2 = -C_8H_{17}$-t
$-C_{12}H_{25}$-s
$-C_6H_{13}$-t

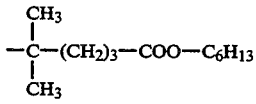

-continued
$-C_8H_{17}$-s
$-C_{15}H_{31}$

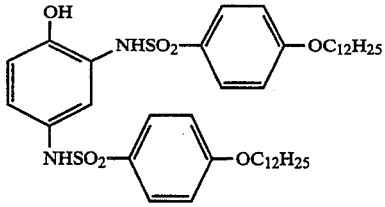

When a photographic material contains several partial layers of the same spectral sensitization, these may differ from one another in their composition, in particular in the nature and quantity of the silver halide grains. The more highly sensitive partial layer is generally arranged further away from the support than the less sensitive partial layer. Partial layers having the same spectral sensitization may be adjacent to one another or separated by other layers, e.g. by layers of a different spectral sensitization. Thus, for example, all highly sensitive layers may be combined in one layer packet and all low sensitive layers in another packet (DE-A-19 58 709, DE-A-25 30 645, DE-A-26 22 922).

The photographic material may also contain UV light absorbent compounds, white toners, spacers, filter dyes, formalin acceptors, light protective agents, antioxidants, $D_{min}$ dyes, additives for improving the stabilization of dyes, couplers and whites and for reducing the colour fog, plasticizers (latices), biocides, etc. UV-light absorbent compounds should on the one hand protect the image dyes against bleaching by daylight rich in UV-light and on the other hand act as filter dyes to absorb the UV-light in daylight when exposure takes place so as to improve the colour reproduction of a film. Compounds differing in structure are normally used for the two different functions. Examples are: Aryl substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) and benzoxazole compounds (U.S. Pat. No. 3,700,455).

The following are examples of particularly suitable compounds:

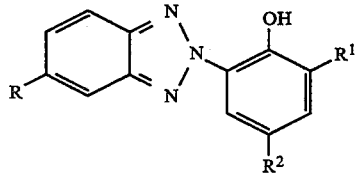

UV-1 R, $R^1$ = H; $R^2$ = $-C_4H_9$-t

UV-2 R = H; $R^1$, $R^2$ = $-C_4H_9$-t

UV-3 R = H; $R^1$, $R^2$ = $-C_5H_{11}$-t

UV-4 R = H; $R^1$ = $-C_4H_9$-s; $R^2$ = $C_4H_9$-t

UV-5 R = Cl; $R^1$ = $-C_4H_9$-t; $R^2$ = $C_4H_9$-s

UV-6 R = Cl; $R^1$, $R^2$ = $-C_4H_9$-t

-continued

UV-7 R = Cl; $R^1$ = $-C_4H_9$-t; $R^2$ = $-CH_2-CH_2-COOC_8H_{17}$

UV-8 R = H; R= $-C_{12}H_{25}$ -i; $R^2$ = $-CH_3$

UV-9 R, $R^1$, $R^2$ = $-C_4H_9$-t

UV-10 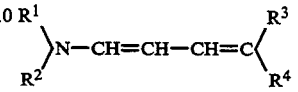

UV-11 $R^1$, $R^2$ = $-C_6H_{13}$-n; $R^3$, $R^4$ = $-CN$

UV-12 $R^1$, $R^2$ = $-C_2H_5$;

$R^3$ = $-SO_2-$ 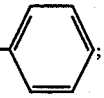 ; $R^4$ = $-CO-OC_8H_{17}$

UV-13 $R^1$, $R^2$ = $-C_2H_5$;

$R^3$ = $-SO_2-$ 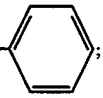 ; $R^4$ = $-COO-C_{12}H_{25}$

UV-14 $R^1$, $R^2$ = $-CH_2=CH-CH_2$; $R^3$, $R^4$ = $-CN$

UV-15 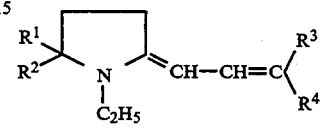

UV-16 $R^1$, $R^2$ = H; $R^3$ = $-CN$; $R^4$ = $-CO-NHC_{12}H_{25}$

UV-17 $R^1$, $R^2$ = $-CH_3$; $R^3$ = $-CN$; $R^4$ = $-CO-NHC_{12}H_{25}$

UV-18 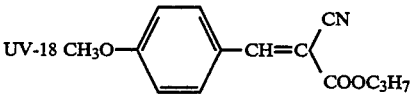

Ultraviolet absorbent couplers (such as cyan couplers of the α-naphthol series) and ultraviolet absorbent polymers may also be used. These ultraviolet absorbents may be fixed in a particular layer by mordants.

Filter dyes suitable for visible light include oxonole dyes, hemioxonole dyes, styryl dyes, merocyanine dyes, cyanine dyes and azo dyes. Among these, oxonole dyes, hemioxonole dyes and merocyanine dyes are particularly suitable.

Suitable white toners are described, for example, in Research Disclosure 17 643 (December 1978), Chapter V, in U.S. Pat. Nos. 2,632,701 and 3,269,840 and in GB-A-852 075 and 1 319 763.

Certain layers of binders, in particular those furthest removed from the support but occasionally also interlayers, particularly if these were furthest removed from the support during the preparation of the material, may contain photographically inert particles of an organic or inorganic nature, e.g. as matting agents or as spacers (DE-A-33 31 542, DE-A-34 24 893, Research Disclosure 17 643 (December 1978), Chapter XVI).

The average particle diameter of the spacers is in particular in the range of from 0.2 to 10 μm. The spacers are insoluble in water and may be soluble or insoluble in alkalies. Those which are soluble in alkalies are generally removed from the photographic material in the alkaline development bath. Examples of suitable polymers are: Polymethylmethacrylate, copolymers of acrylic acid and methylmethacrylate, and hydroxypropyl methylcellulose hexahydrophthalate.

Additives for improving the stability of the dyes, couplers and whites and for reducing the colour fog (Research Disclosure 17 643 (December 1978), Chapter VII) may belong to the following classes of chemical compounds: Hydroquinones, 6-hydroxychromans, 5-hydroxycoumarans, spirochromans, spiroindanes, p-alkoxyphenols, sterically hindered phenols, gallic acid derivatives, methylene dioxybenzenes, aminophenols, sterically hindered amines, derivatives containing esterified or etherified phenolic hydroxyl groups, and metal complexes.

Compounds containing a sterically hindered amine partial structure and a sterically hindered phenol partial structure in one and the same molecule (U.S. Pat. No. 4,268,593) are particularly effective in preventing any impairment to yellow colour images as a result of the development of heat, moisture and light. To prevent impairment to magenta colour images, in particular as a result of the action of light, spiroindanes (JP-A-159 644.81) and chromans (JP-A-89 835/80) are particularly effective, apart from the compounds of formula II according to the invention.

The following are examples of particularly suitable compounds:

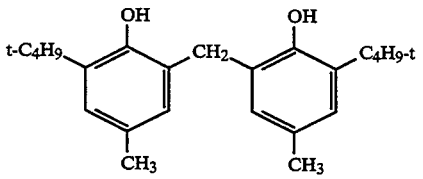

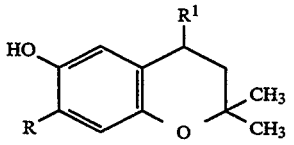

R = $-C_8H_{17}$-t; $R^1$ = $-CH_3$

R = $-C_8H_{17}$; $R^1$ = $-C_3H_7$-i

-continued

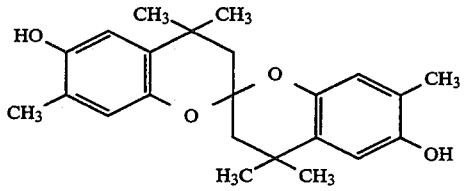

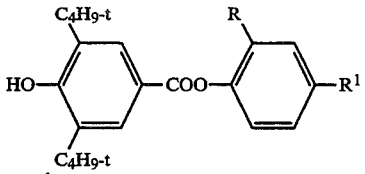

R, $R^1$ = —$C_4H_9$-t
R, $R^1$ = —$C_5H_{11}$-t

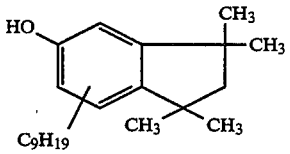

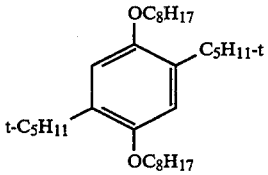

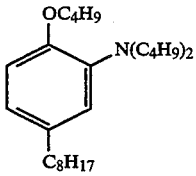

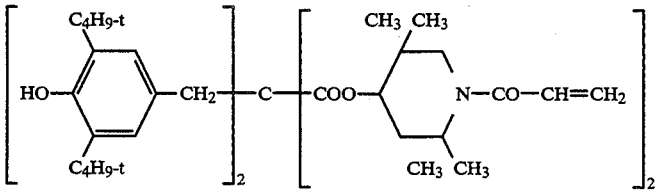

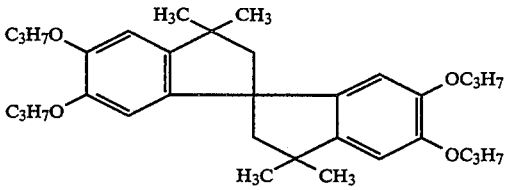

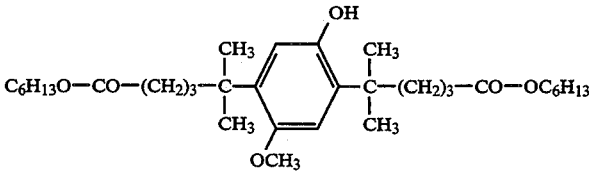

and the compounds mentioned above as EOP acceptors.

Colour photographic recording materials are normally processed by development, bleaching, fixing and washing or by development, bleaching, fixing and stabilisation not followed by washing, and bleaching and fixing may be combined in one process step. The colour developer compounds used may be any developer compounds which are capable, in the form of their oxidation products, of reacting with colour couplers to form azomethine dyes or indophenol dyes. Suitable colour developer compounds include aromatic compounds of the p-phenylenediamine series containing at least one primary amino group, for example: N, N-Dialkyl-p-phenylenediamines such as N,N-diethyl-p-phenylenediamine, 1-(N-ethyl-N-methanesulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other suitable colour developers are described, for example, in J. Amer. Chem. Soc. 73, 3106 (1951) and by G. Haist in Modern Photographic Processing, 1979, John Wiley and Sons, New York, page 545 et seq. Colour development may be followed by an acid short stop bath or by washing.

The material is normally bleached and fixed immediately after colour development. The bleaching agents used may be e.g. Fe(III) salts and Fe(III) complex salts such as ferricyanides, dichromates or water-soluble cobalt complexes. Iron-(III) complexes of aminopolycarboxylic acids are particularly preferred, in particular e.g. the complexes of ethylenediaminotetracetic acid, propylenediaminotetracetic acid, diethylenetriaminopentacetic acid, nitrilotriacetic acid, iminodiacetic acid, N-hydroxyethylethylenediaminotriacetic acid, alkyliminodicarboxylic acids and of corresponding phosphonic acids. Persulphates and peroxides are also suitable bleaching agents, e.g. hydrogen peroxide.

The bleach fixing bath or fixing bath is in most cases followed by washing, which is carried out as a counterflow washing or in several tanks, each with its own water supply.

Advantageous results may be obtained if this is followed by a final bath containing little or no formaldehyde.

Washing may also be completely replaced by a stabilizing bath, which is normally operated in countercurrent. This stabilizing bath also takes over the function of a final bath when formaldehyde is added.

In colour reversal materials, development with a black-and-white developer whose oxidation product is not capable of reacting with the colour couplers is first carried out. This is followed by a diffuse second exposure which in turn is followed by development with a colour developer, bleaching and fixing.

EXAMPLES

EXAMPLE 1

10 g of the couplers shown in Table 1 are dissolved with 10 g of dibutylphthalate and 20 g of ethyl acetate and then emulsified in the usual manner in 100 g of a 10% gelatine solution containing 0.5% dodecylbenzene sulphonate. The ethyl acetate is then evaporated off.

The emulsion obtained is added to a green-sensitized silver chloride emulsion so that the mixture then contains 1.3 g of coupler per 1 g of $AgNO_3$.

After the addition of a wetting agent, the casting solution is applied to a polyethylene coated paper so that the coating contains 0.55 g of $AgNO_3/m^2$. This is then covered with a gelatine protective layer containing 0.8 g q5 of gelatine/$m^2$.

A hardening layer consisting of 400 mg of gelatine and 400 mg of instant hardener CAS Reg.-No.65 411-60-11 is then cast on the gelatine protective layer. The combination of layers is dried at 50° to 60° C. When dry, the paper is exposed to a 3/2-step wedge behind a blue filter and processed as follows:

| | |
|---|---|
| a) Colour developer - 45 s - 35° C. | |
| Triethanolamine | 9.0 g |
| N,N-diethylhydroxylamine | 6.0 g |
| Diethylene glycol | 0.05 g |
| 3-Methyl-4-amino-N-ethyl-N-methane sulphonamidoethyl-aniline sulphate | 6.0 g |
| Potassium sulphite | 0.2 g |
| Triethyleneglycol | 0.05 g |
| Potassium carbonate | 22.0 g |
| Potassium hydroxide | 0.4 g |
| Ethylene diaminotetracetic acid, disodium salt | 2.2 g |
| made up with water to 1,000 ml; pH 9.2. | |
| b) Bleach fixing bath - 45 s - 35° C. | |
| Ammonium thiosulphate | 75 g |
| Sodium hydrogen sulphite | 13.5 g |
| Ammonium acetate | 2.0 g |
| Ethylene diaminotetracetic acid (iron-ammonium salt) | 57.0 g |
| Ammonia, 25% | 9.5 g |
| Acetic acid | 9.0 g |
| made up with water to 1000 ml; ph 5.5 | |
| c) Washing - 2 min - 33° C. | |

The wedges thus obtained are then irradiated for varying lengths of time with a Xeno test apparatus.

The residual densities left from different starting densities (0.5; 1.0; 1.5; $D_{max}$) are then measured and given in terms of % regression, based on the starting densities (Table 1).

The following couplers were used:

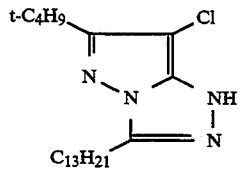

XM-1

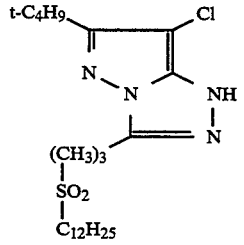

XM-2

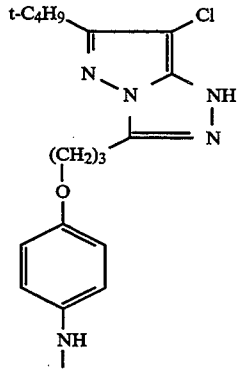

XM-3

-continued

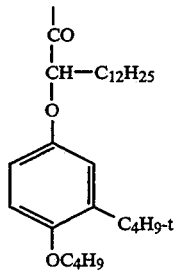

XM-4

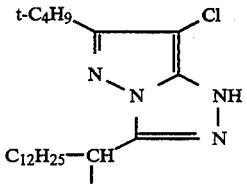

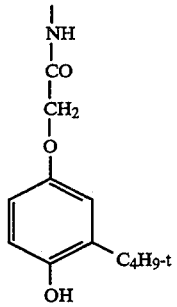

XM-5

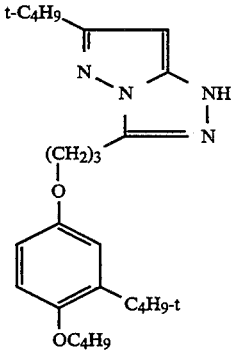

Layers in addition containing 50% (based on the couplers) of the following stabilizers CS-1 to CS-4 and of Stabilizer compound 1 according to the invention are prepared by the same method.

CS-1

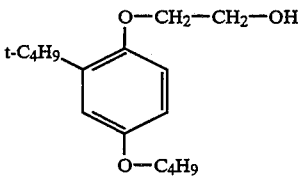

CS-2

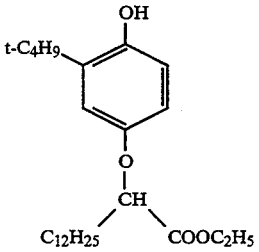

CS-3

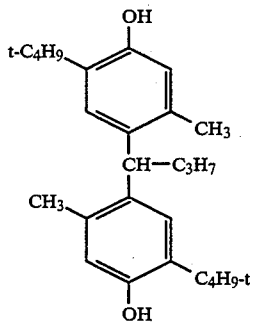

CS-4

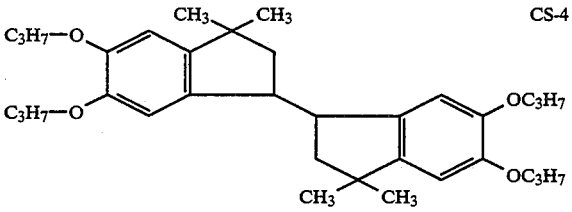

TABLE 1

| Coupler | Stabilizer | 2.4 × $10^6$ lux.h Density 0.5 | 1.0 | 1.5 | $D_{max}$ | 4.8 × $10^6$ lux.h Density 0.5 | 1.0 | 1.5 | $D_{max}$ | 14.4 × $10^6$ lux.h Density 0.5 | 1.0 | 1.5 | $D_{max}$ |
|---|---|---|---|---|---|---|---|---|---|---|---|---|---|
| XM-1 | — | 66 | 60 | 30 | 12 | 70 | 50 | 46 | 25 | 88 | 85 | 65 | 66 |
| XM-2 | — | 55 | 49 | 28 | 10 | 68 | 50 | 47 | 20 | 80 | 80 | 75 | 66 |
| XM-3 | — | 60 | 40 | 30 | 15 | 80 | 75 | 46 | 28 | 90 | 80 | 75 | 66 |
| XM-4 | — | 52 | 50 | 33 | 17 | 70 | 65 | 50 | 33 | 87 | 78 | 72 | 65 |
| XM-5 | — | 37 | 32 | 16 | 8 | 32 | 33 | 25 | 16 | 50 | 45 | 40 | 35 |
| XM-1 | CS-1 | 38 | 30 | 14 | 7 | 46 | 45 | 23 | 15 | 46 | 46 | 32 | 30 |
| XM-2 | CS-1 | 45 | 35 | 20 | 12 | 50 | 49 | 27 | 21 | 52 | 48 | 38 | 42 |
| XM-3 | CS-1 | 46 | 32 | 28 | 10 | 50 | 48 | 33 | 15 | 64 | 58 | 39 | 30 |
| XM-4 | CS-1 | 38 | 48 | 42 | 22 | 46 | 54 | 45 | 25 | 70 | 68 | 58 | 40 |
| XM-5 | CS-1 | 25 | 28 | 14 | 6 | 38 | 30 | 25 | 14 | 42 | 38 | 38 | 27 |
| XM-1 | CS-2 | 45 | 40 | 18 | 12 | 52 | 51 | 34 | 28 | 55 | 53 | 40 | 33 |
| XM-2 | CS-2 | 48 | 40 | 28 | 17 | 53 | 52 | 35 | 30 | 58 | 52 | 48 | 49 |
| XM-3 | CS-2 | 50 | 40 | 35 | 15 | 55 | 52 | 37 | IS | 70 | 70 | 68 | 35 |
| XM-4 | CS-2 | 48 | 45 | 57 | 30 | 55 | 60 | 49 | 30 | 75 | 71 | 62 | 50 |
| XM-5 | CS-2 | 28 | 30 | 20 | 15 | 42 | 35 | 30 | 20 | 50 | 42 | 45 | 30 |
| XM-1 | CS-3 | 45 | 42 | 20 | 15 | 55 | 54 | 39 | 32 | 58 | 52 | 42 | 33 |
| XM-2 | CS-3 | 50 | 42 | 30 | 19 | 55 | 54 | 37 | 33 | 62 | 54 | 50 | 50 |
| XM-3 | CS-3 | 52 | 42 | 37 | 17 | 57 | 54 | 40 | 21 | 70 | 72 | 70 | 35 |

TABLE 1-continued

| | | $2.4 \times 10^6$ lux.h Density | | | | $4.8 \times 10^6$ lux.h Density | | | | $14.4 \times 10^6$ lux.h Density | | | |
|---|---|---|---|---|---|---|---|---|---|---|---|---|---|
| Coupler | Stabilizer | 0.5 | 1.0 | 1.5 | $D_{max}$ | 0.5 | 1.0 | 1.5 | $D_{max}$ | 0.5 | 1.0 | 1.5 | $D_{max}$ |
| XM-4 | CS-3 | 50 | 47 | 52 | 30 | 55 | 60 | 48 | 29 | 72 | 68 | 65 | 40 |
| XM-5 | CS-3 | 32 | 32 | 24 | 20 | 55 | 38 | 35 | 24 | 52 | 44 | 40 | 38 |
| XM-1 | CS-4 | 48 | 45 | 25 | 20 | 53 | 54 | 40 | 19 | 68 | 60 | 55 | 40 |
| XM-2 | CS-4 | 50 | 45 | 28 | 20 | 53 | 52 | 42 | 20 | 70 | 65 | 58 | 40 |
| XM-3 | CS-4 | 52 | 45 | 30 | 22 | 58 | 50 | 40 | 32 | 70 | 68 | 60 | 42 |
| XM-4 | CS-4 | 55 | 45 | 32 | 27 | 60 | 55 | 48 | 28 | 70 | 65 | 60 | 55 |
| XM-5 | CS-4 | 33 | 28 | 12 | 4 | 38 | 30 | 20 | 16 | 48 | 40 | 28 | 40 |
| XM-1 | 1 | 30 | 21 | 15 | 6 | 28 | 26 | 24 | 15 | 59 | 50 | 38 | 25 |
| XM-2 | 1 | 30 | 21 | 14 | 9 | 37 | 25 | 23 | 14 | 55 | 51 | 37 | 28 |
| XM-3 | 1 | 35 | 23 | 18 | 15 | 35 | 28 | 22 | 13 | 52 | 50 | 38 | 25 |
| XM-4 | 1 | 30 | 23 | 20 | 16 | 38 | 27 | 24 | 14 | 52 | 50 | 40 | 28 |
| XM-5 | 1 | 20 | 16 | 8 | 4 | 25 | 20 | 20 | 10 | 40 | 25 | 20 | 22 |

Table 1 shows that compared with the state of the art compounds (CS-1 to CS-4) the stabilizers according to the invention provide substantially better stability to light in combination with pyrazoloazole couplers.

EXAMPLE 2

A colour photographic recording material suitable for rapid processing was prepared by applying the following layers in the given sequence to a layer support of paper coated with polyethylene on both sides. The quantities are based in each case on 1 $m^2$. The quantities of silver halide applied are given in the corresponding quantities of $AgNO_3$.

Sample 1:

Layer 1: (Subbing layer) 0.2 g gelatine

Layer 2: (blue sensitive layer) blue sensitive silver halide emulsion (99.5 mol-% chloride, 0.5 mol-% bromide, average grain diameter 0.8 μm) obtained with 0.63 g of $AgNO_3$ with 1.38 g of gelatine, 0.95 g of Yellow coupler XY-1, 0.2 g of White coupler XW-1 and 0.29 g of tricresylphosphate (TCP)

Layer 3: (protective layer) 1.1 g of gelatine, 0.06 g of 2,5-dioctylhydroquinone and 0.06 g of dibutylphthalate (DBP)

Layer 4: (green sensitive layer) green sensitized silver halide emulsion (99.5 mol-% chloride, 0.5 mol-% bromide, average grain diameter 0.6 μm) from 0.45 g of $AgNO_3$ with 1.08 g of gelatine, 0.41 g of magenta coupler XM-2, 0.08 g of 2,5-dioctylhydroquinone and 0.55 g of TCP Layer 5: (red sensitive layer) red sensitized silver halide emulsion (99.5 mol-% chloride, 0.5 mol-% bromide, average grain diameter 0.5 μm) from 0.3 g of $AgNO_3$ with 0.75 g of gelatine, 0.36 g of cyan coupler XC-1 and 0.36 g of TCP Layer 6: (protective layer) 0.9 g of gelatine and 0.3 g of hardener carbamoyl pyridinium salt (CAS Reg. No. 65411-60-1)

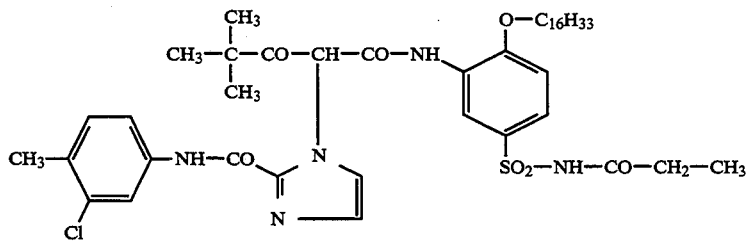

XY-1

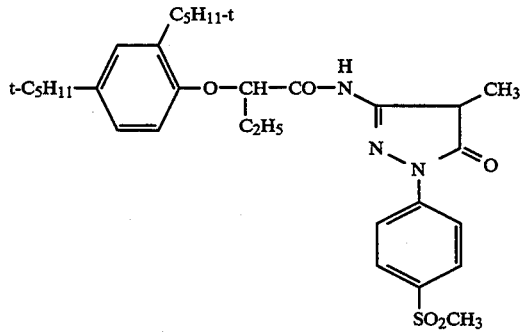

XW-1

-continued

XC-1

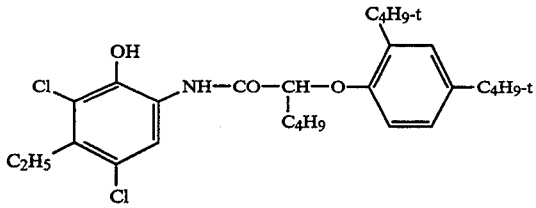

Samples 2,3 and 14 were prepared by the same method as Sample 1 except that half the quantity of stabilizer CS-1 from Example 1 or of Compounds 1 and 16 according to the invention, based on the quantity of XM-2, was in addition added to the 4th layer (green-sensitive).

The samples obtained were exposed to green light behind a graduated grey wedge and then processed.

The maximum colour density of the samples was then.

In addition, the samples were exposed to $7.2\times10^6$ Lux.h from a Xenon lamp standardised for daylight; the percentage reduction in density was then measured (Table 2)

TABLE 2

| Sample | Coupler | Stabilizer | 7.2 · $10^6$ lux.h Density 0.5 | 1.0 | 1.5 | $D_{max}$ |
|---|---|---|---|---|---|---|
| 1 | XM-2 | — | 70 | 62 | 55 | 32 |
| 2 | XM-2 | CS-1 | 65 | 55 | 48 | 27 |
| 3 | XM-2 | 1 | 24 | 18 | 15 | 10 |
| 4 | XM-2 | 16 | 26 | 20 | 18 | 12 |

EXAMPLE 3

The materials of Example 2 (Samples 1 to 4 ) were modified in that an additional layer 4*a* having the following composition was introduced between layers 4 and 5:

1.15 g gelatine 0.6 g UV absorbent corresponding to the formula

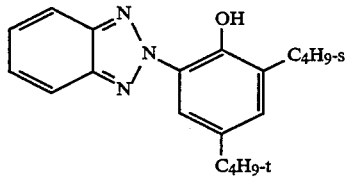

0.04 g tricresylphosphate 0.045 g 2,5-dioctylhydroquinone and an additional layer 5*a* having the following composition was interposed between layers 5 and 6:

0.35 g gelatine 0.16 g UV absorbent as in Layer 4*a*

0.03 g UV absorbent corresponding to the formula

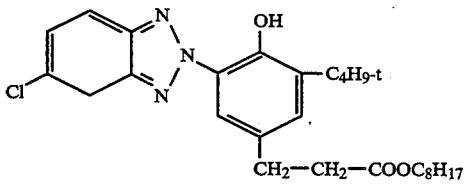

0.08 g 2,5-dioctylhydroquinone, 0.20 g tricresylphosphate (Samples 1A, 2A, 3A, 4A).

The following percentage regressions in density were observed after irradiation in the Xenon test apparatus (Table 3 ):

TABLE 3

| Sample | 7.2 × $10^6$ lux.h Density 0.5 | 1.0 | 1.5 | $D_{max}$ |
|---|---|---|---|---|
| 1A | 62 | 52 | 50 | 25 |
| 2A | 60 | 48 | 40 | 28 |
| 3A | 20 | 15 | 10 | 8 |
| 4A | 19 | 14 | 12 | 6 |

EXAMPLE 4

When a mixture of equal parts of CS-1 and Compound 1 are used in the 4th Layer in Example 2, the values found in the Example (Sample 3) are again improved by 10%.

EXAMPLE 5

A single photographic layer (Sample 1) prepared according to Example 1 containing 0.41 g of magenta coupler M-60 and 0.20 g of Stabilizer 2 according to the invention per $m^2$ was exposed to result in a density of 1.0 after processing (Sample 1). A Sample 2 was prepared similarly but instead of Stabilizer 2 it contained the same quantity of CS-1. A third sample (Sample 3) was prepared completely without stabilizer.

All 3 Samples were irradiated in a Xenon test apparatus for 20 days. The percentage residual densities based on the starting density 1=100% were plotted against the irradiation time (FIG. 1). Graphs 1, 2 and 3 represent the stabilities of Samples 1, 2 and 3.

We claim:

1. A color photographic recording material comprising at least one light-sensitive silver halide emulsion layer containing a magenta coupler and optionally other light-sensitive and light-insensitive layers, wherein the magenta coupler corresponds to the following general formula I:

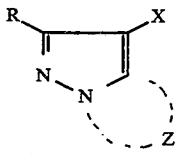

I wherein

R denotes H or a substituent;

X denotes H or a group which can be split off under the conditions of chromogenic development;

Z denotes the group required for completing a condensed nitrogen-containing ring;

and said layer containing the magenta coupler of Formula I in addition contains at least one compound corresponding to the following general formula II

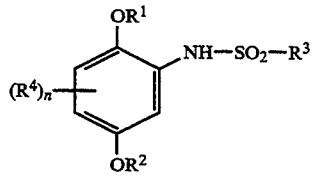

II wherein $R^1$ and $R^2$ are the same or different and denote alkyl, aryl or a heterocyclic group; $R^1$ or $R^2$ or both $R^1$ and $R^2$ may also combine with one of the groups $R^4$ to form a 5- to 7-membered heterocyclic ring containing at least one oxygen atom, $R^3$ denotes alkyl, alkenyl, aryl or a heterocyclic group;

$R^4$ denotes a substituent selected from the group consisting of halogen, CN, $NO_2$ or an organic radical; one group $R^4$ may combine with another group $R^4$ or with $R^1$ or $R^2$ to form a 5–7-membered ring, or it may form an oxygen-containing ring together with $R^1$ or $R^2$;

n stands for 0 or an integer from 1 to 3.

2. Recording material according to claim 1, wherein the magenta coupler corresponds to one of the following formulae I-C and I-D:

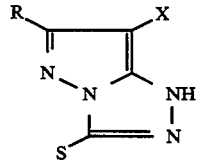

I-C

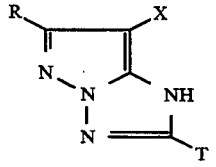

I-D wherein the substituents denoted by R, S and T are hydrogen, alkyl, aralkyl, aryl, alkoxy, aroxy, alkylthio, arylthio, amino, anilino, acylamino, cyano, alkoxycarbonyl, carbamoyl or sulphamoyl and X is hydrogen or a group which can be split off under the conditions of chromogenic development.

3. A recording material according to claim 1, wherein R in the I-C, and I-D, denotes tertiary butyl.

4. Recording material according to claim 1, wherein the magenta coupler corresponds to the following general formula I-L:

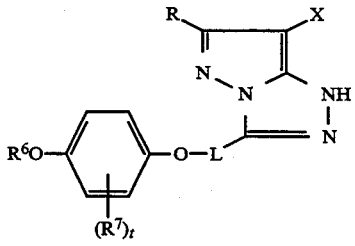

(I-L)

wherein

R denotes alkyl;

$R^6$ denotes an alkyl group optionally substituted by OH, alkoxy, COOH or aryl;

$R^7$ denotes alkyl or aryl; or $R^6$ and $R^7$ together form a group for completing a 5-, 6- or 7-membered, optionally substituted ring;

t stands for 0 to 4;

L denotes a straight chain or branched alkylene group optionally interrupted by O;

X is H or a group which can be split off under the conditions of chromogenic development.

5. The recording material according to claim 4, wherein R in the formula I-L denotes tertiary butyl.

6. Recording material according to claim 1, wherein the magenta coupler is in the form of a latex coupler.

7. Recording material according to claim 1, wherein the layers are arranged on a light-reflecting support.

8. Recording material according to claim 7, wherein the halide component of the silver halide emulsion consists of at least 95 mol % chloride.

9. The recording material according to claim 7, wherein the halide component of the silver halide emulsion consists of at least 99 mol % of chloride.

10. Recording material according to claim 1, wherein the layer containing the magenta coupler of formula I is a green-sensitive silver halide emulsion layer with the magenta coupler of formula I and wherein the material further contains at least one red-sensitive silver halide emulsion layer with a cyan coupler of formula V and at least one blue-sensitivie silver halide emulsion layer with a yellow coupler of formula VII

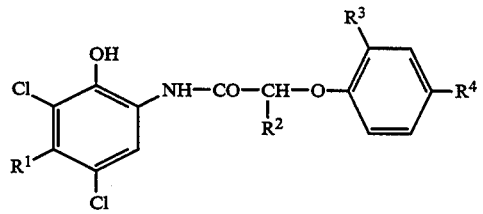

V wherein $R^1$ denotes ethyl;

$R^2$, $R^3$ and $R^4$ denote alkyl;

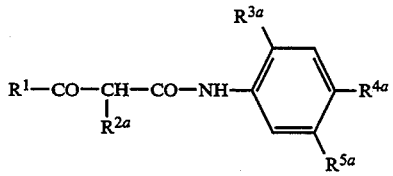

VII wherein $R^{1a}$ denotes t-butyl;

$R^{2a}$ denotes a group which can be split off under the conditions of chromogenic development;

$R^{3a}$ denotes halogen or alkoxy;

$R^{4a}$ denotes H;

$R^{5a}$ denotes acylamino, carbamoyl, alkoxycarbonyl, suphonamide or sulphamoyl.

11. The recording material as claimed in claim 1, wherein the organic radical is selected from the group consisting of alkyl, aryl, alkoxy, aryloxy, alkylthio, arhylthio, amino, acylamino, sulphamido, carbamoyl, alkoxycarbonyl, sulphamoyl, alkylsulphonyl and arylsulphonyl.

12. The recording material as claimed in claim 1, wherein $R^4$ is combined with another $R^4$ or with $R^1$ or $R^2$ to form a condensed benzene ring.

13. The recording material as claimed in claim 1, wherein the magenta couplers are selected from the group consisting of formulas I-A, I-B, I-C, I-D, I-E and I-F

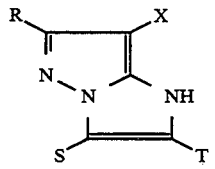
I-A

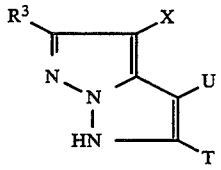
I-B

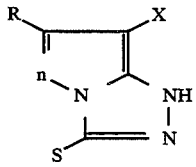
I-C

-continued

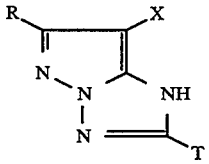
I-D

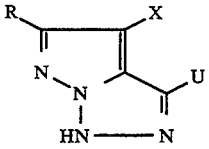
I-E

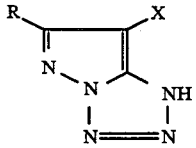
I-F wherein

R, S, T and U are identical or different and are selected from the group consisting of hydrogen, alkyl, aralkyl, aryl, alkoxy, aroxy, alkylthio, arylthio, amino, anilino, acylamino, cyano, alkxoycarbonyl, carbamoyl and sulphamoyl.

14. The recording material as claimed in claim 1, wherein X is a halogen atom or a cyclic group attached to the coupling position.

15. The recording material as claimed in claim 14, wherein said cyclic group is attached to the coupling position by an oxygen atom, a sulphur atom or a nitrogen atom.

16. The recording material as claimed in claim 15, wherein the cyclic group is attached by oxygen corresponding to the formula —O—$R^5$ wherein $R^5$ stands for a cyclic organic radical.

17. The recording material as claimed in claim 16, wherein $R^5$ is a substituted or unsbustituted phenyl group.

* * * * *